US008872445B2

(12) United States Patent
Egawa et al.

(10) Patent No.: US 8,872,445 B2
(45) Date of Patent: Oct. 28, 2014

(54) LED DRIVING CIRCUIT

(75) Inventors: Shunji Egawa, Tokorozawa (JP); Isao Ochi, Tokorozawa (JP)

(73) Assignee: Citizen Holdings Co., Ltd., Tokyo (JP)

( * ) Notice: Subject to any disclaimer, the term of this patent is extended or adjusted under 35 U.S.C. 154(b) by 94 days.

(21) Appl. No.: 13/579,633

(22) PCT Filed: Feb. 25, 2011

(86) PCT No.: PCT/JP2011/055003

§ 371 (c)(1),
(2), (4) Date: Aug. 17, 2012

(87) PCT Pub. No.: WO2011/105630

PCT Pub. Date: Sep. 1, 2011

(65) Prior Publication Data

US 2012/0313541 A1 Dec. 13, 2012

(30) Foreign Application Priority Data

Feb. 26, 2010 (JP) ..... 2010-043019
Jun. 22, 2010 (JP) ..... 2010-141722

(51) Int. Cl.
*H05B 41/36* (2006.01)
*H05B 33/08* (2006.01)

(52) U.S. Cl.
CPC ..... *H05B 33/083* (2013.01); *H05B 33/0827* (2013.01)
USPC ..... 315/307; 315/291; 315/312; 315/200 R

(58) Field of Classification Search
CPC ..... H05B 33/0815; H05B 33/0833; H05B 33/0845; H05B 33/0884; H01L 25/0753; H01L 25/167; H02J 7/0063; H02J 7/025; F21V 23/04; F21V 23/0471
USPC ..... 315/88, 89, 90, 119, 121, 122, 123, 315/125, 127, 128, 185 R, 186, 192, 193, 315/200 R, 201, 205, 210, 224, 291, 294, 315/295, 297, 299, 306, 307, 310, 312, 361, 315/362
See application file for complete search history.

(56) References Cited

U.S. PATENT DOCUMENTS 8,164,276 B2 4/2012 Kuwabara
8,324,840 B2 * 12/2012 Shteynberg et al. ..... 315/308
2010/0134031 A1 * 6/2010 Shuy et al. ..... 315/246

FOREIGN PATENT DOCUMENTS

JP 2002-25784 1/2002
JP 2005-122979 5/2005

(Continued)

OTHER PUBLICATIONS

International Search Report from the Japanese Patent Office, mailed May 31, 2011, for International Application No. PCT/JP2011/055003.

*Primary Examiner* — Douglas W Owens
*Assistant Examiner* — Jianzi Chen
(74) *Attorney, Agent, or Firm* — Finnegan, Henderson, Farabow, Garrett & Dunner, L.L.P.

(57) ABSTRACT

The invention is directed to the provision of an LED driving circuit that switches the connection of LED blocks in accordance with the supply voltage and the Vf's specific to individual LEDs contained in each LED block. The LED driving circuit includes a rectifier; a first circuit, a first current detection unit for detecting current flowing from the first LED array to the negative output of the rectifier, and a first current limiting unit for limiting the current flowing from the first LED array to the negative output of the rectifier in accordance with the current detected by the first current detection unit, and a second circuit which includes a second LED array and a current path passing through the second LED array and leading to the negative output of the rectifier, and wherein a current path in which only the first LED array is connected to the rectifier and a current path are formed in accordance with an output voltage of the rectifier, and the first current detection unit, upon detecting current flowing through the first and second LED arrays, operates the first current limiting unit to perform current path switching.

11 Claims, 13 Drawing Sheets

(56) References Cited

FOREIGN PATENT DOCUMENTS

| | | |
|---|---|---|
| JP | 2006-244648 | 9/2006 |
| JP | 2009-10100 | 1/2009 |
| JP | 2009-123427 | 6/2009 |
| JP | 2009-290245 | 12/2009 |
| JP | 2010-109168 | 5/2010 |
| JP | 2011-40701 | 2/2011 |

* cited by examiner

Fig. 13 - PRIOR ART
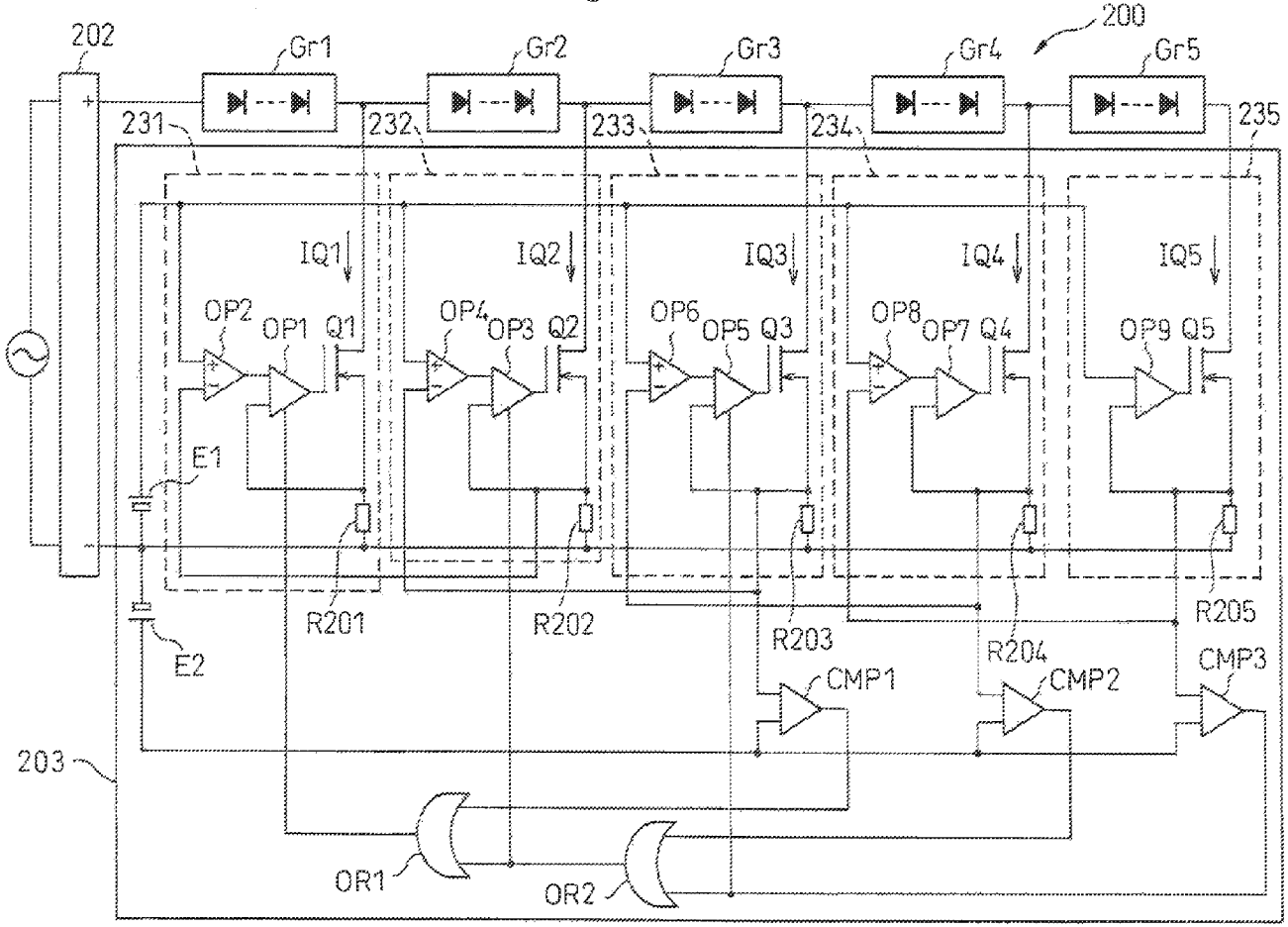

LED DRIVING CIRCUIT

TECHNICAL FIELD

The present invention relates to an LED driving circuit, and more particularly to an LED driving circuit for producing efficient LED light emission using an AC power supply.

BACKGROUND

In lighting equipment using LEDs, AC power supplied from a commercial power supply is full-wave rectified by a diode bridge, and the rectified output voltage is applied across a plurality of series-connected LEDs, causing the plurality of LEDs to emit light.

LEDs have nonlinear characteristics such that, when the voltage being applied across the LED reaches or exceeds its forward voltage drop (Vf), current suddenly begins to flow. Desired light emission is produced by flowing a prescribed forward current (If) by a method that inserts a current limiting resistor or that forms a constant current circuit using some other kind of active device. The forward voltage drop that occurs here is the forward voltage (Vf). Accordingly, in the case of a plurality, n, of LEDs connected in series, the plurality of LEDs emit light when a voltage equal to or greater than n×Vf is applied across the plurality of LEDs. On the other hand, the rectified voltage that the diode bridge outputs by full-wave rectifying the AC power supplied from the commercial power supply varies between 0 (v) and the maximum output voltage periodically at a frequency twice the frequency of the commercial power supply. This means that the plurality of LEDs emit light only when the rectified voltage reaches or exceeds n×Vf (v), but do not emit light when the voltage is less than n×Vf (v).

To address this deficiency, it is known to provide an LED driving circuit in which a plurality of LEDs are blocked into four groups (3-1 to 3-10, 3-11 to 3-20, 3-21 to 3-30, and 3-31 to 3-40) and a switching device for connecting each LED group to a rectifier is controlled in accordance with the output voltage of the rectifier (refer, for example, to patent document 1).

This prior known circuit, however, requires the provision of a switch circuit for switching the connection mode of the plurality of LED blocks, and the switch circuit can only be controlled by a method that switches the connection based either on a comparison between the rectified voltage and the output of a current detector or on the rectified voltage. Therefore, with this prior known LED driving circuit, it is not possible to set proper switching voltage in advance by using an economical method, and there has therefore been the problem that not only does the overall size and cost of the LED driving circuit increase, but the power consumption also increases because of the power required to drive the switch circuit. In particular, if the light-emission period of the LEDs is to be further lengthened, the number of LED blocks has to be increased, but if the number of LED blocks is increased, the number of switch circuits required correspondingly increases.

Further, the switching timing of the switch circuit is set based on the predicted value of n×Vf (v), but since Vf somewhat varies from LED to LED, the actual value of n×Vf (v) of each LED block differs from the preset value of n×Vf (v). This has led to the problem that even if the switch circuit is set to operate in accordance with the supply voltage, the LEDs in the respective blocks may not emit light as expected, or conversely, even if the switching is made earlier than the preset timing, the LEDs may emit light; hence, the difficulty in optimizing the light-emission efficiency and the power consumption of the LEDs.

It is also known to provide a method in which a plurality of LED blocks, each containing a plurality of LEDs, are connected in series and are controlled on and off in an efficient manner in accordance with the rectified voltage output from a full-wave rectifier (refer, for example, to patent document 2).

FIG. 13 is a diagram schematically illustrating the configuration of the prior known LED driving circuit 200 disclosed in the above patent document 2. The prior known LED driving circuit 200 will be described below with reference to FIG. 13.

In the LED driving circuit 200, LED blocks Gr1 to Gr5, each containing a plurality of LEDs, are connected in series to the full-wave rectifier 202. The LED driving circuit 200 further includes circuits 231 to 235 corresponding to the respective LED blocks Gr1 to Gr5. Further, the LED driving circuit 200 includes comparators CMP1 to CMP3 and OR circuits OR1 and OR2 which are used to turn off the LED blocks Gr1 to Gr3.

The circuits 231 and 232 perform control to maintain the sum of a drain current IQ1, which flows from the LED block Gr1 to an nMOSFET Q1, and a drain current IQ2, which flows from the LED block Gr2 to an nMOSFET Q2, constant. As the rectified output voltage of the full-wave rectifier gradually increases from a voltage just sufficient to cause the LED block Gr1 to emit light to a voltage sufficient to cause the LED blocks Gr1 and Gr2 to emit light, the drain current IQ2 begins to flow. Here, if the drain currents IQ1 and IQ2 are allowed to flow freely, the current flowing through the LED block Gr1 may exceed the allowable amount; therefore, the circuits 231 and 232 perform control to maintain the sum of the drain currents IQ1 and IQ2 constant. That is, when the rectified output voltage of the full-wave rectifier reaches the voltage sufficient to cause the LED blocks Gr1 and Gr2 to emit light, control is performed to block the drain current IQ1 and to allow only the drain current IQ2 to flow. In this condition, the LED blocks Gr1 and Gr2 are connected in series to the full-wave rectifier, and the LEDs contained in the LED blocks Gr1 and Gr2 emit light.

Similarly, when the rectified output voltage of the full-wave rectifier reaches a voltage sufficient to cause the LED blocks Gr1 to Gr3 to emit light, the circuits 232 and 233 perform control so as to block the drain current IQ2 and to allow only the drain current IQ3 to flow. In this condition, the LED blocks Gr1 to Gr3 are connected in series to the full-wave rectifier, and the LEDs contained in the LED blocks Gr1 to Gr3 emit light.

When the rectified output voltage of the full-wave rectifier further rises and reaches a voltage sufficient to cause the LED blocks Gr1 to Gr4 to emit light, the circuits 233 and 234 perform control so as to block the drain current IQ3 and to allow only the drain current IQ4 to flow. In this condition, the LED blocks Gr1 to Gr4 are connected in series to the full-wave rectifier, and the LEDs contained in the LED blocks Gr1 to Gr4 emit light.

When the rectified output voltage of the full-wave rectifier further rises and reaches a voltage sufficient to cause the LED blocks Gr1 to Gr5 to emit light, the circuits 234 and 235 perform control so as to block the drain current IQ4 and to allow only the drain current IQ5 to flow. In this condition, the LED blocks Gr1 to Gr5 are connected in series to the full-wave rectifier, and the LEDs contained in the LED blocks Gr1 to Gr5 emit light.

In this way, the circuits 231 to 235 perform control so as to maintain the sum of the drain currents constant by sequentially blocking the drain current flowing in each circuit on the downstream side (the full-wave rectifier side).

However, for example, when the drain current IQ2 is blocked, and the drain current IQ3 is allowed to flow, if the drain current IQ1 begins to flow, a large current will flow through the LED block Gr1, which is not desirable. Therefore, when the drain current IQ3 flows, control is performed to set the output of the comparator CMP1 high and thereby send a control signal via OR1 to the circuit 231 so that the drain current IQ1 can be blocked in a reliable manner.

Similarly, when the drain current IQ4 flows, control is performed to set the output of the comparator CMP2 high and thereby send a control signal via OR1 and OR2 to the circuits 231 and 232 so that the drain currents IQ1 and IQ2 can be blocked in a reliable manner.

Further, when the drain current IQ5 flows, control is performed to set the output of the comparator CMP3 high and thereby send a control signal via OR1 and OR2 to the circuits 231 to 233 so that the drain currents IQ1, IQ2, and IQ3 can be blocked in a reliable manner.

As described above, in the prior known LED driving circuit 200, each time an additional LED block is connected in series to the full-wave rectifier 202, control must be performed so that the current does not flow from any of the currently connected LED blocks directly to the full-wave rectifier. For example, consider the situation where the current is flowing with the LED blocks Gr1 to Gr4 connected in series to the full-wave rectifier, and the LED block Gr5 is additionally connected in series to the full-wave rectifier; in this case, the drain currents IQ1 to IQ3 are controlled digitally so that the currents do not flow from the respective LED blocks Gr1 to Gr4 directly to the full-wave rectifier 202, and the drain current IQ4 is controlled in analog so that the sum of the drain currents IQ4 and IQ5 is maintained constant.

In this way, when connecting a maximum number, N, of LED blocks in series to the full-wave rectifier, the prior known LED driving circuit 200 requires the provision of control circuitry that performs control to block the currents flowing from the (N−1) LED blocks to the full-wave rectifier. This has led to the problem that the digital control circuit becomes complex, increasing the size and cost of the entire circuitry.

Patent document 1: Japanese Unexamined Patent Publication No. 2006-244848 (FIG. 1)

Patent document 2: Japanese Unexamined Patent Publication No. 2010-109168 (FIG. 1)

SUMMARY

Accordingly, it is an object of the present invention to provide an LED driving circuit that aims to solve the above problems.

It is also an object of the present invention to provide an LED driving circuit that switches the connection of LED blocks with proper timing while eliminating the need to operate a switch circuit in accordance with a supply voltage.

An LED driving circuit according to the present invention includes a rectifier having a positive output and a negative output, a first circuit which includes a first LED array connected to the rectifier, a first current detection unit for detecting current flowing from the first LED array to the negative output of the rectifier, and a first current limiting unit for limiting the current flowing from the first LED array to the negative output of the rectifier in accordance with the current detected by the first current detection unit, and a second circuit which includes a second LED array and a current path passing through the second LED array and leading to the negative output of the rectifier, and wherein a current path in which only the first LED array is connected to the rectifier and a current path in which the first LED array and the second LED array are connected in series relative to the rectifier are formed in accordance with an output voltage of the rectifier, and the first current detection unit, upon detecting current flowing through the first and second LED arrays, operates the first current limiting unit so as to effect switching to the current path in which the first LED array and the second LED array are connected in series relative to the rectifier.

Preferably, in the LED driving circuit, the first current limiting unit blocks any current that flows from the first LED array to the negative output of the rectifier without passing through the second LED array.

Preferably, in the LED driving circuit, the first current limiting unit blocks any current that flows from the positive output of the rectifier to the first LED array without passing through the second LED array.

Preferably, in the LED driving circuit, the first current detection unit detects the current flowing through the first LED array to the first current detection unit and operates the first current limiting unit so as to block the current flowing from the first LED array to the negative output of the rectifier and thereby to effect switching from the current path in which only the first LED array is connected to the rectifier to the current path in which the first LED array and the second LED array are connected in series relative to the rectifier.

Preferably, in the LED driving circuit, the first current detection unit detects the current flowing from the positive output of the rectifier to the first LED array and operates the first current limiting unit so as to block the current flowing from the positive output of the rectifier to the first LED array and thereby to effect switching from the current path in which only the first LED array is connected to the rectifier to the current path in which the first LED array and the second LED array are connected in series relative to the rectifier.

Preferably, the LED driving circuit further comprises an intermediate circuit which is connected between the first circuit and the second circuit, and which includes a third LED array, a third current detection unit for detecting current flowing from the third LED array to the negative output of the rectifier, and a third current limiting unit for limiting the current flowing from the third LED array to the negative output of the rectifier in accordance with the current detected by the third current detection unit.

Preferably, the LED driving circuit includes a plurality of such intermediate circuits between the first circuit and the second circuit.

Preferably, in the LED driving circuit, the second LED array is connected in parallel with the first current limiting unit.

Preferably, in the LED driving circuit, a second current detection unit for detecting current flowing from the second LED array to the first current detection unit and a second current limiting unit for limiting the current flowing from the second LED array to the first current detection unit in accordance with the current detected by the second current detection unit are connected, together with the second LED array, in parallel with the first current limiting unit.

Preferably, in the LED driving circuit, the current limiting unit is a current regulating circuit, a current regulative diode, or a current limiting resistor.

Preferably, the LED driving circuit further comprises a smoothing circuit connected to the rectifier.

An alternative LED driving circuit according to the present invention includes a rectifier having a positive output and a negative output, a first circuit which includes a first LED array connected to the rectifier, a first current detection unit for detecting current flowing from the first LED array to the negative output of the rectifier, and a first current limiting unit for limiting the current flowing from the first LED array to the negative output of the rectifier in accordance with the current detected by the first current detection unit, and a second circuit which includes a second LED array and a current path passing through the second LED array and leading to the negative output of the rectifier, and wherein the first current limiting unit and the second LED array are connected in parallel, and the first current detection unit is located outside the parallel connection of the first current limiting unit and the second LED array, and a current path in which only the first LED array is connected to the rectifier and a current path in which the first LED array and the second LED array are connected in series relative to the rectifier are formed in accordance with an output voltage of the rectifier.

In the LED driving circuit, since control is performed to switch the connection between the respective LED blocks automatically as the supply voltage varies, there is no need to digitally control a switch circuit by using a control signal, and it becomes possible to simplify the configuration of the driving circuit and reduce the cost.

Further, in the LED driving circuit, since the timing for switching the LED block connection is automatically determined in accordance with the supply voltage and the sum of the actual Vf's of the individual LEDs contained in each LED block, there is no need to perform control by predicting the switching timing of each LED block from the number of LEDs contained in the LED block, and it thus becomes possible to switch the connection between the respective LED blocks with the most efficient timing.

Furthermore, since the LED driving circuit eliminates the need to digitally control a switch circuit by using a control signal, a large number of LED blocks may be provided (which means that the number of LED arrays can be increased), in which case the number of LEDs in each LED block can be reduced correspondingly, In this case, since each LED block can be driven to emit light with a lower supply voltage, the power consumption of the LEDs can be increased. Taken to extremes, as many LED blocks (LED arrays) as there are LEDs can be formed.

In the LED driving circuit of the present invention, the first current detection unit, upon detecting current flowing through the first and second LED arrays, operates the first current limiting unit so as to effect switching to the current path in which the first LED array and the second LED array are connected in series relative to the rectifier. Accordingly, when switching the current path, there is no need to make special provision to block the drain current flowing directly to the drain current from the LED block currently connected to the rectifier.

BRIEF DESCRIPTION OF THE DRAWINGS

FIGS. 3(*b*) to 3(*d*) are diagrams showing current waveforms taken at particular portions in the circuit example 1'.

FIG. 13 is a diagram schematically illustrating the configuration of a prior known LED driving circuit 200.

DESCRIPTION OF EMBODIMENTS

LED driving circuits will be described below with reference to the accompanying drawings. It will, however, be noted that the technical scope of the present invention is not limited to the specific embodiments described herein but extends to the inventions described in the appended claims and their equivalents.

Figure 1:
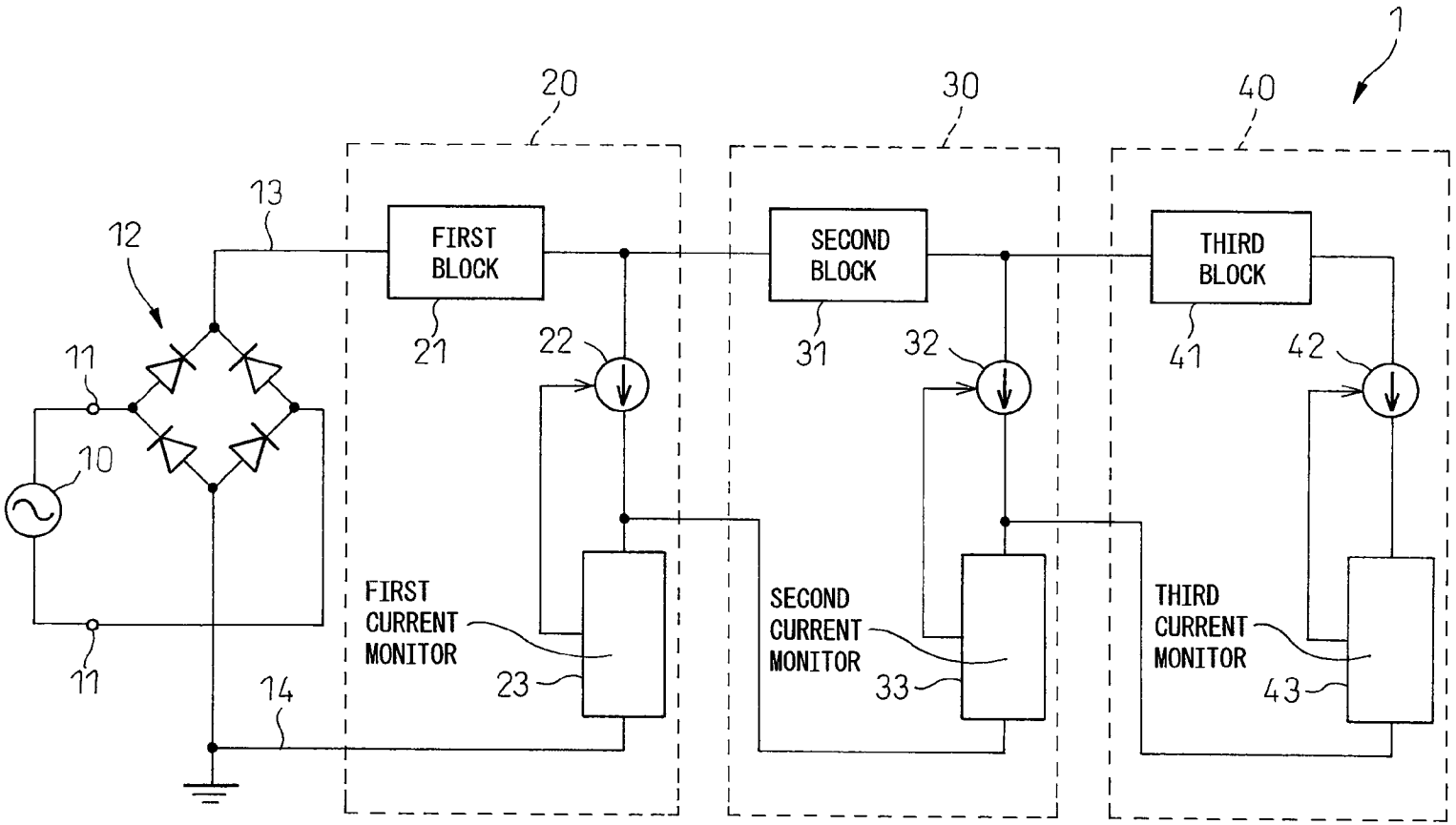
FIG. 1 is a diagram schematically illustrating the configuration of an LED driving circuit 1.

FIG. 1 is an explanatory schematic diagram of an LED driving circuit 1.

The LED driving circuit 1 comprises a pair of connecting terminals 11 for connection to an AC commercial power supply (100 VAC) 10, a full-wave rectification circuit 12, a first circuit 20, a second circuit 30, and a third circuit 40.

The first circuit 20 includes a first LED block (LED array) 21 containing one or a plurality of LEDs, a first current limiting unit 22 for controlling current flowing through the first LED block 21, and a first current monitor 23 for detecting the current and thereby controlling the current set in the first current limiting unit 22.

The second circuit 30 includes a second LED block (LED array) 31 containing one or a plurality of LEDs, a second current limiting unit 32 for controlling current flowing through the second LED block 31, and a second current monitor 33 for detecting the current and thereby controlling the current value set in the second current limiting unit 32, and this circuit is connected in parallel with the first current limiting unit 22. More specifically, the first current limiting unit 22 and the second LED block 31 are connected in parallel, and the first current monitor 23 is located outside the parallel connection of the first current limiting unit 22 and the second LED block 31.

The third circuit 40 includes a third LED block (LED array) 41 containing one or a plurality of LEDs, a third current limiting unit 42 for controlling current flowing through the third LED block 41, and a third current monitor 43 for detecting the current and thereby controlling the current value set in the third current limiting unit 42, and this circuit is connected in parallel with the second current limiting unit 32. More specifically, the second current limiting unit 32 and the third LED block 41 are connected in parallel, and the second current monitor 33 is located outside the parallel connection of the second current limiting unit 32 and the third LED block 41.

Figure 2:
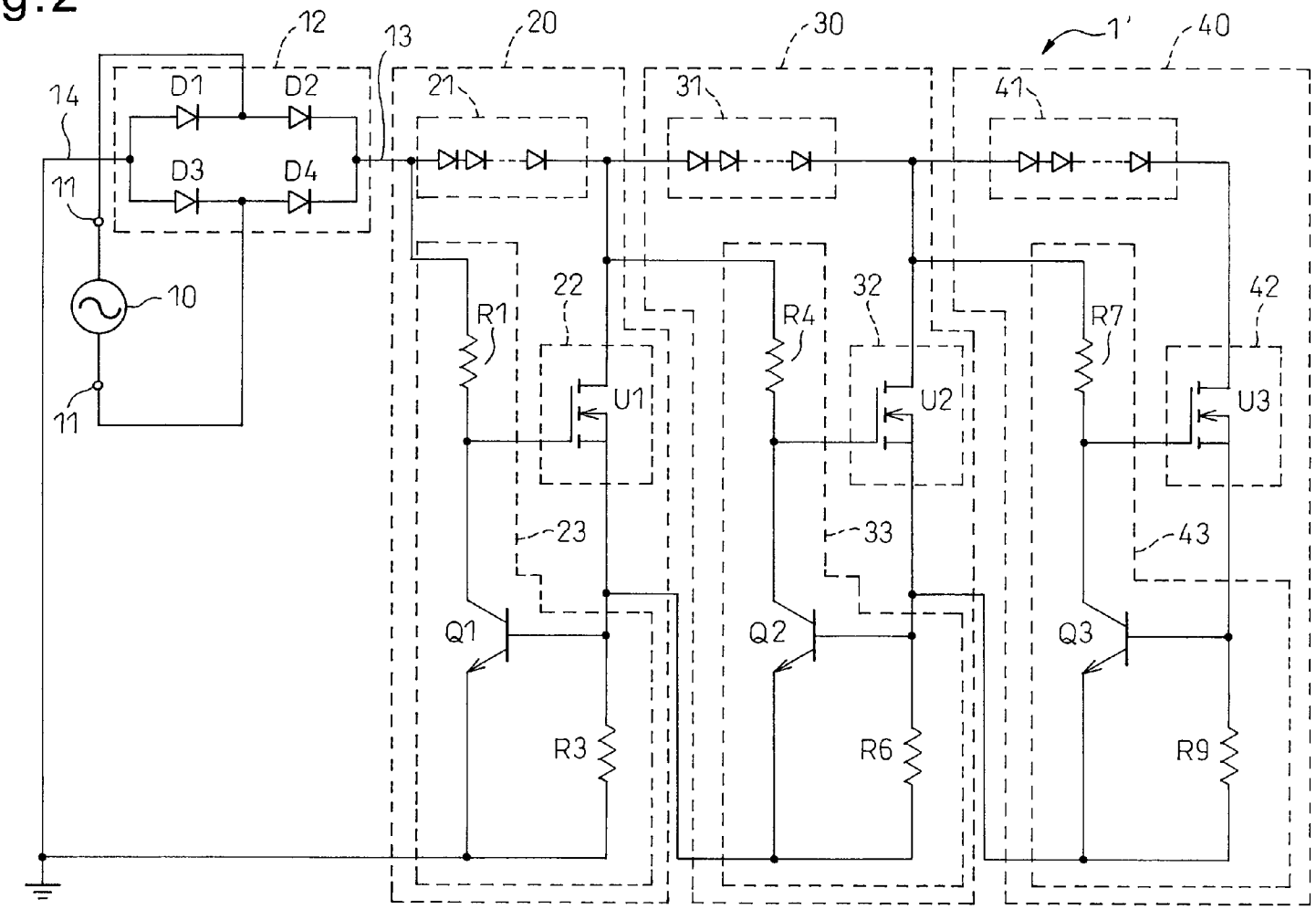
FIG. 2 is a diagram showing a specific circuit example l' implementing the LED driving circuit 1 of FIG. 1.

FIG. 2 is a diagram showing a specific circuit example 1' implementing the LED driving circuit 1 of FIG. 1. In the circuit example 1', the same component elements as those in FIG. 1 are designated by the same reference numerals, and the portions corresponding to the respective component elements in FIG. 1 are enclosed by dashed lines.

In the circuit example 1', the pair of connecting terminals 11 is for connection to the AC commercial power supply 10, and is formed as a bayonet base when the LED driving circuit 1 is used for an LED lamp.

The full-wave rectification circuit 12 is a diode bridge circuit constructed from four rectifying elements D1 to D4, and includes a positive output 13 and a negative output 14. The full-wave rectification circuit 12 may be a full-wave rectification circuit that contains a voltage transformer circuit, or a two-phase full-wave rectification circuit that uses a transformer with a center tap.

The first LED block 21 in the first circuit 20 contains 15 series-connected LEDs. The first current monitor 23 comprises two resistors R1 and R3 and a transistor Q1, and the first current limiting unit 22 comprises an N-type MOSFET U1 and forms a current regulating circuit. The basic operation of the current regulating circuit will be described. The current regulating circuit shown here makes use of a voltage drop that occurs across the resistor R3 in the first current monitor 23 due to the drain current of the MOSFET U1 of the first current limiting unit 22. This voltage drop causes the base voltage of the transistor Q1 to change, thus causing a change in the collector current of the transistor Q1 flowing through the resistor R1. This change is used to adjust the gate voltage of the MOSFET U1 and thereby limit the drain current of the MOSFET U1.

First, when the current flowing through the resistor R3 in the first current monitor 23 is smaller than a prescribed current, the voltage drop across the resistor R3 is small; as a result, the base voltage of the transistor Q1 decreases, and the emitter-collector current of the transistor Q1 also decreases. In this case, since the voltage drop across the resistor R1 is also small, the gate voltage of U1 increases, and U1 is thus controlled to increase its drain-source current. Conversely, when the current flowing through the resistor R3 in the first current monitor 23 is larger than the prescribed current, the base voltage of the transistor Q1 increases, and the emitter-collector current also increases. As a result, the gate voltage of U1 decreases, and U1 is thus controlled to decrease its drain-source current. That is, the drain-source current of U1 is controlled so that the current flowing through the resistor R3 is maintained constant.

The second LED block 31 in the second circuit 30 contains 12 series-connected LEDs, and is connected in parallel with the first current limiting unit 22. The second current monitor 33 and the second current limiting unit 32 are identical in configuration and operation to the first current monitor 23 and the first current limiting unit 22.

The third LED block 41 in the third circuit 40 contains nine series-connected LEDs, and is connected in parallel with the second current limiting unit 32. The third current monitor 43 and the third current limiting unit 42 are identical in configuration and operation to the first current monitor 23 and the first current limiting unit 22.

In the circuit example 1', the 15 LEDs connected in series in the first LED block 21 emit light when a voltage approximately equal to a first forward voltage V1 ($15\times Vf=15\times 3.2=48.0$ (v)) is applied across the first LED block 21. On the other hand, 12 LEDs are connected in series in the second LED block 31; therefore, when a voltage approximately equal to a second forward voltage V2 ($(15+12)\times Vf=27\times 3.2=86.4$ (v)) is applied across a series connection of the first LED block 21 and the second LED block 31, the LEDs contained in the first and second LED blocks 21 and 31 emit light. Likewise, nine LEDs are connected in series in the third LED block 41; therefore, when a voltage approximately equal to a third forward voltage V3 ($(15+12+9)\times Vf=36\times 3.2=115.2$ (v)) is applied across a series connection of the first to third LED blocks 21 to 41, the LEDs contained in the first to third LED blocks 21 to 41 emit light.

In the case of the commercial power supply voltage of 100 V, the maximum voltage is about 141 (v). The voltage stability should take into account a variation of about ±10%. The forward voltage of each of the rectifying elements D1 to D4 of the full-wave rectification circuit 12 is 1.0 (v); therefore, when the commercial power supply voltage is 100 (v), the maximum output voltage of the full-wave rectification circuit 12 is about 139 (v). In the circuit example 1', the total number of LEDs in the first to third LED blocks 21 to 41 has been chosen to be 36 so that the voltage given as the total number $(n)\times Vf$ ($36\times 3.2=115.2$), when all the LEDs are connected in series, does not exceed the maximum output voltage of the full-wave rectification circuit 12.

When all the LEDs are connected in series, not only the forward voltage V3 of the LEDs but the presence of the factors contributing to the voltage drop across the third current limiting unit 42 and the voltage drop across the third current monitor 43 need be considered, and the variation of the output voltage of the full-wave rectification circuit 12 need also be considered. Therefore, in actuality, the total number, n, of LEDs is not determined by only considering so that the forward voltage V3 does not exceed the maximum output voltage of the full-wave rectification circuit 12 as described above.

For example, when the total number of LED blocks is three, the voltage drop across the third current limiting unit 42 is set so as not to exceed one quarter of the maximum output voltage of the full-wave rectification circuit 12. On the other hand, the voltage drop across the third current monitor 43 is about 0.6 V, which has no effect when determining the total number of LEDs. It is therefore desirable to set the combined forward voltage V3 of the n LEDs be set not smaller than 75% but smaller than 90% of the maximum output voltage of the full-wave rectification circuit 12. That is, when the total number, n, of LEDs is calculated from $139\times 0.75\leq n\times 3.2<139\times 0.90$, the total number from 33 to 39 is desirable; therefore, in the illustrated example, the total number has been set to 36. With this arrangement, power loss at any portion other than the LEDs can be reduced, and the electricity conversion efficiency can be increased. Further, all the LEDs can be driven to emit light despite variations in the supply voltage. While the forward voltage Vf of each LED has been assumed to be 3.2 (v), the actual value somewhat varies among the individual LEDs, as earlier noted.

It should also be noted that the circuit configuration shown in the circuit example 1' of FIG. 2 is only illustrative and not restrictive, and that various changes and modifications can be made to the configuration including the number of LEDs contained in each of the first to third LED blocks 21 to 41.

Figure 3:
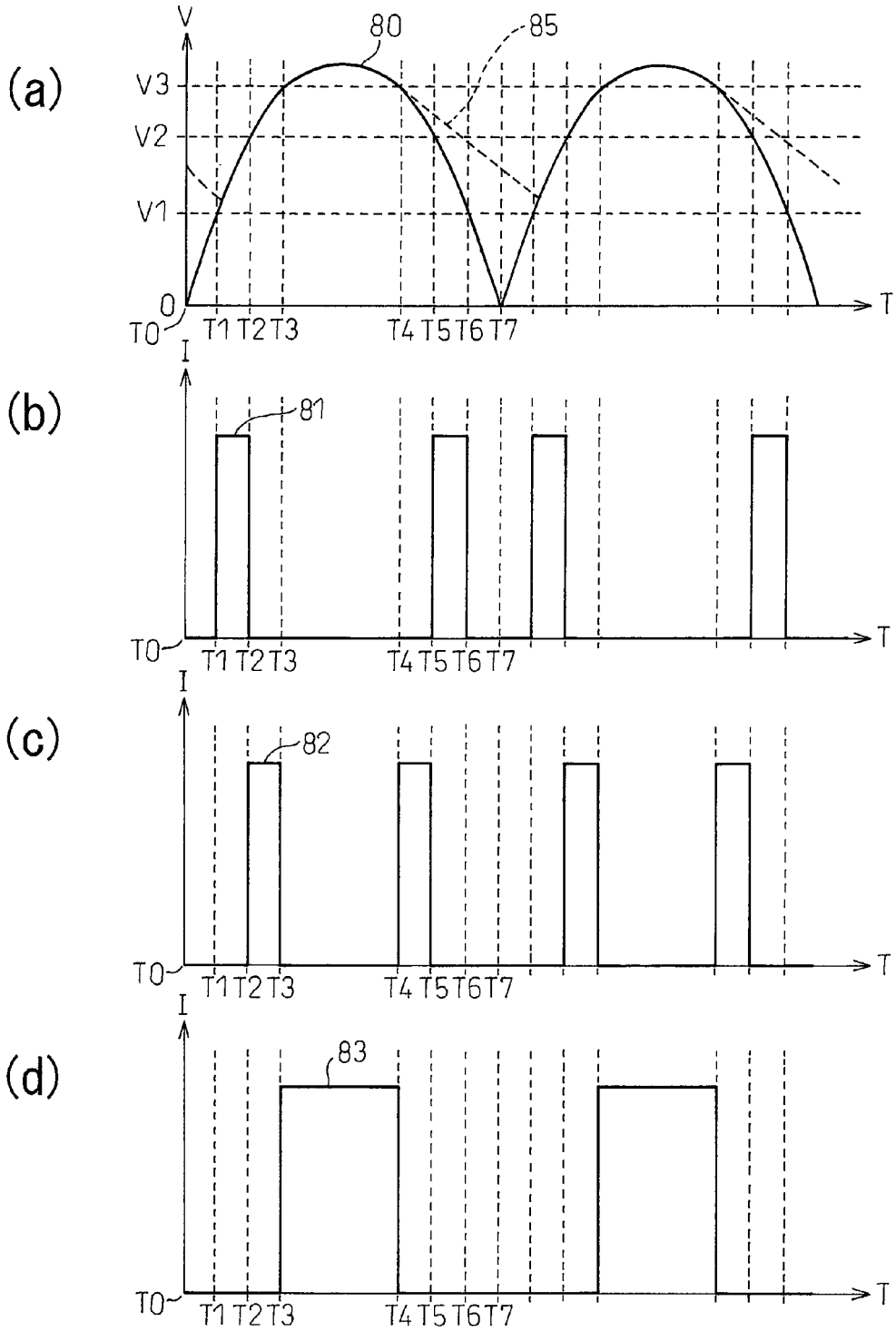
FIG. 3(*a*) is a diagram showing an output voltage waveform example of a full-wave rectification circuit.
Figure 4:
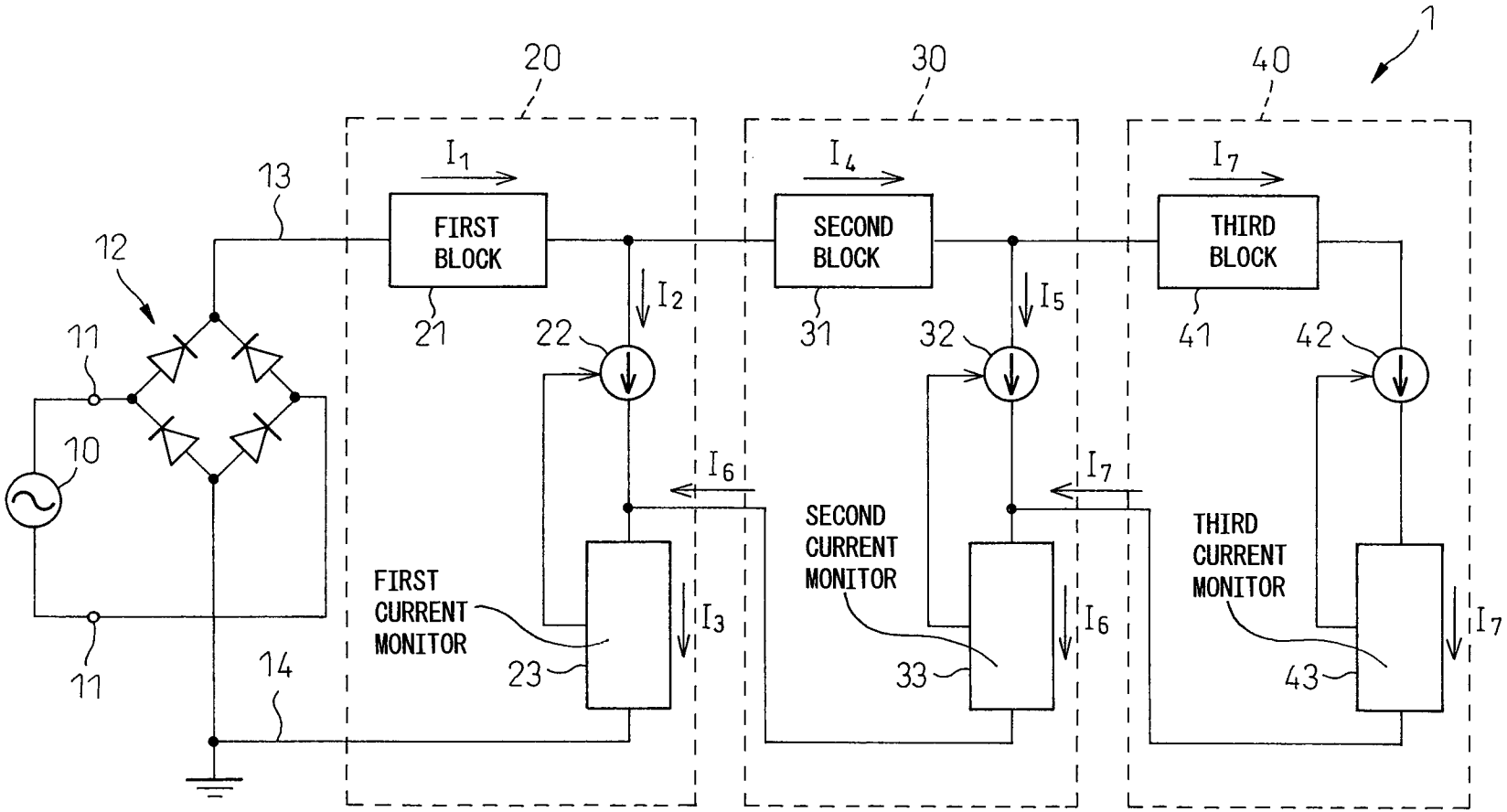
FIG. 4 is a diagram for explaining the operation of the circuit example 1'.

The operation of the circuit example 1' will be described below with reference to FIGS. 3 and 4. FIG. 3(*a*) is a diagram showing an output voltage waveform example 80 of the full-wave rectification circuit 12, FIG. 3(*b*) is a diagram showing a current waveform 81 taken at the first current limiting unit 22 in the circuit example 1', FIG. 3(*c*) is a diagram showing a current waveform 82 taken at the second current limiting unit 32 in the circuit example 1', FIG. 3(*d*) is a diagram showing a current waveform 83 taken at the third current limiting unit 42 in the circuit example 1', and FIG. 4 is a diagram for explaining the operation of the circuit example 1'.

At time T0 (see FIG. 3) when the output voltage of the full-wave rectification circuit 12 is 0 (v), since the voltage for causing any one of the first to third LED blocks 21 to 41 to emit light is not reached yet, the LEDs contained in any of the LED blocks remain OFF.

At time T1 (see FIG. 3) when the output voltage of the full-wave rectification circuit 12 reaches the first forward voltage V1 sufficient to cause the first LED block 21 to emit light, current I1 begins to flow, causing the LEDs contained in the first LED block 21 to emit light. Here, since Vf varies among the individual LEDs in the first LED block 21, as earlier noted, whether the LEDs actually begin to emit light at the first forward voltage V1 (48.0 (v)) depends on the actual circuit. Anyway, when the voltage equal to the sum of the Vf's of the 15 LEDs contained in the first LED block 21 is applied, the 15 LEDs contained in the first LED block 21 begin to emit light. The same applies for the second and third forward voltages V2 and V3.

At time T1 (see FIG. 3), the output voltage of the full-wave rectification circuit 12 reaches the first forward voltage V1 whose output is sufficient to cause the first LED block 21 to emit light but falls short of the voltage for further causing the second and third LED blocks 31 and 41 to emit light. In this case, the current I1 flows through the first LED block 21, but none of currents I4 to I6 flow in the second circuit 30 containing the second LED block 31, because the applied voltage, i.e., the voltage drop across the current limiting unit 22, is low (see FIG. 4). Likewise, current I7 does not flow in the third circuit 40 containing the third LED block 41.

In the state reached at time T1, the first current monitor 23 detects the current I3 flowing therethrough and controls the first current limiting unit 22 so that the current I3 becomes equal to a prescribed value. More specifically, in this state, the current I1 flowing through the first LED block 21 is detected, and the current is controlled to a prescribed value, that is, I1=I2=I3. The current waveform 81 in FIG. 3(*b*) corresponds to the current I2.

At time T2 (see FIG. 3) when the output voltage of the full-wave rectification circuit 12 reaches the second forward voltage V2 sufficient to cause the first and second LED blocks 21 and 31 to emit light, a current path is formed so as to connect the first and second LED blocks 21 and 31 in series relative to the full-wave rectification circuit 12, and the LEDs contained in the first and second LED blocks 21 and 31 emit light.

Before reaching time T2, only the first LED block 21 is ON and, in this condition, the output voltage of the full-wave rectification circuit 12 nears the second forward voltage V2; as a result, the voltage drop across the first current control unit 22 nears the forward voltage of the second LED block 31 in the second circuit 30 connected in parallel therewith, and the current I4 begins to flow. However, since the output voltage is still short of the third forward voltage V3, the current I7 does not flow. Therefore, in this state, I4=I5=I6, I3=I2+I6, and I1=I2+I4. Here, since the current I3 increases due to the addition of the current I4 (=current I6), the first current monitor 23 monitoring the current I3 operates so as to limit (reduce) the current I2 by controlling the first current limiting unit 22. Such operation is repeated when switching the current path, and the current I4 gradually increases while the current I2 gradually decreases and finally drops to zero at time T2, achieving the state I1=I4=I5=I6=I3. That is, the first current limiting unit 22 functions as a current limiting circuit that limits the current I2. The current waveform 82 in FIG. 3(*c*) corresponds to the current I5.

Accordingly, at time T2, switching is automatically made from the state in which only the first LED block 21 is ON to the state in which the first and second LED blocks 21 and 31 are both ON. This switching is not performed by using a control signal, etc. by presetting the switching voltage for each LED block. Rather, the operation is performed automatically to switch the current path when the voltage drop across the first current limiting unit 22 nears the forward voltage of the second LED block 31 in the second circuit 30 connected in parallel therewith. More specifically, in the illustrated example, when the output voltage of the full-wave rectification circuit 12 rises up to the voltage equal to the sum of the Vf's of the LEDs contained in the respective LED blocks, switching is automatically made from the current path in which only the first LED block 21 is ON to the current path in which the first and second LED blocks 21 and 31 are both ON.

At time T3 (see FIG. 3) when the output voltage of the full-wave rectification circuit 12 reaches the third forward voltage V3 sufficient to cause the first to third LED blocks 21 to 41 to emit light, a current path is formed so as to connect the first to third LED blocks 21 to 41 in series relative to the full-wave rectification circuit 12, and the LEDs contained in the first to third LED blocks 21 to 41 emit light.

Before reaching time T3, the first and second LED blocks 21 and 31 are ON and, in this condition, the output voltage of the full-wave rectification circuit 12 nears the third forward voltage V3; as a result, the voltage drop across the second current limiting unit 32 nears the forward voltage of the third LED block 41 in the third circuit 40 connected in parallel therewith, and the current I7 begins to flow. Therefore, in this state, I4=I5+I7, I6=I5+I7, I1=I4, and I2=0. Here, since the current I6 increases due to the addition of the current I7, the second current monitor 33 monitoring the current I6 operates so as to limit (reduce) the current I5 by controlling the second current limiting unit 32. Such operation is repeated when switching the current path, and the current I7 gradually increases while the current I5 gradually decreases and finally drops to zero at time T3, achieving the state I1=I4=I6=I7. That is, the second current limiting unit 32 functions as a current limiting circuit that limits the current I5. The current waveform 83 in FIG. 3(*d*) corresponds to the current I7.

Accordingly, at time T3, switching is automatically made from the state in which the first and second LED blocks 21 and 31 are ON to the state in which all of the first to third LED blocks 21 to 41 are ON. This switching is not performed by using a control signal, etc. by presetting the switching voltage for each LED block, but is performed automatically when the output voltage of the full-wave rectification circuit 12 rises up to the voltage equal to the sum of the Vf's of the LEDs contained in the respective LED blocks.

The third current monitor 43 and third current limiting unit 42 in the third circuit 40 do not contribute to the current path switching, but work cooperatively to adjust the current so that overcurrent does not flow through the respective LED blocks during the period from time T3 to time T4, that is, during the period when all of the first to third LED blocks 21 to 41 are ON. That is, the third current monitor 43 and the third current limiting unit 42 together function as a current regulating circuit.

At time T4 (see FIG. 3) when the output voltage of the full-wave rectifier circuit 12 drops below the third forward voltage V3 sufficient to cause the first to third LED blocks 21 to 41 to emit light, a current path is formed so as to connect the first and second LED blocks 21 and 31 in series relative to the full-wave rectification circuit 12, and the LEDs contained in the third LED block 41 turn off, while the LEDs contained in the first and second LED blocks 21 and 31 remain ON.

Just before reaching time T4, the current I7 begins to decrease as the output voltage of the full-wave rectification circuit 12 nears the third forward voltage V3. Here, since the current I6 decreases correspondingly as the current I7 decreases, the second current monitor 33 monitoring the current I6 operates so as not to limit (so as to increase) the current I5 by controlling the second current limiting unit 32. Such operation is repeated when switching the current path, and the current I7 gradually decreases, while the current I5 gradually begins to flow, and the current I7 finally drops to zero at time T4, achieving the state I1=I3=I4=I5=I6.

Accordingly, at time T4, switching is automatically made from the state in which all of the first to third LED blocks 21 to 41 are ON to the state in which the first and second LED blocks 21 and 31 are ON. This switching is not performed by using a control signal, etc. by presetting the switching voltage for each LED block, but is performed automatically when the output voltage of the full-wave rectification circuit 12 drops below the voltage equal to the sum of the Vf's of the LEDs contained in the respective LED blocks.

At time T5 (see FIG. 3) when the output voltage of the full-wave rectifier circuit 12 drops below the second forward voltage V2 sufficient to cause the first and second LED blocks 21 and 31 to emit light, a current path is formed so as to connect only the first LED block 21 in series to the full-wave rectification circuit 12, and the LEDs contained in the second LED block 31 turn off, while the LEDs contained in the first LED block 21 remain ON.

Just before reaching time T5, the current I4 begins to decrease as the output voltage of the full-wave rectification circuit 12 nears the second forward voltage V2. Here, since the current I3 decreases correspondingly as the current I4 decreases, the first current monitor 23 monitoring the current I3 operates so as not to limit (so as to increase) the current I2 by controlling the first current limiting unit 22. Such operation is repeated when switching the current path, and the current I4 gradually decreases, while the current I2 gradually begins to flow, and the current I4 finally drops to zero at time T5, achieving the state I1=I2=I3.

Accordingly, at time T5, switching is automatically made from the state in which the first and third LED blocks 21 and 31 are ON to the state in which only the first LED block 21 is ON. This switching is not performed by using a control signal, etc. by presetting the switching voltage for each LED block, but is performed automatically when the output voltage of the full-wave rectification circuit 12 drops below the voltage equal to the sum of the Vf's of the LEDs contained in the respective LED blocks.

At time T6 (see FIG. 3) when the output voltage of the full-wave rectifier circuit 12 drops below the first forward voltage V1 sufficient to cause the first LED block 21 to emit light, all the LED blocks are OFF.

A reverse current blocking diode may be inserted between the first LED block 21 and the second LED block 31 and/or between the second LED block 31 and the third LED block 41 in order to protect the first LED block 21 and/or the second LED block 31, respectively.

As described above, in the circuit example 1', since provisions are made to switch the current path in accordance with the output voltage of the full-wave rectification circuit 12, there is no need to provide a large number of switch circuits. Furthermore, since the switching of the current path is automatically determined in accordance with the output voltage of the full-wave rectification circuit 12 and the sum of the actual Vf's of the individual LEDs contained in each LED block, there is no need to perform control by predicting the switching timing of each LED block from the number of LEDs contained in the LED block, and it thus becomes possible to switch the connection between the respective LED blocks with the most efficient timing.

Further, in the LED driving circuit 1 described above, the first current monitor 23 controls the first current limiting circuit 22 by detecting the current flowing through the first and second LED blocks 21 and 31 or through the first to third LED blocks 21 to 41 in the state in which the current is flowing with the first and second LED blocks 21 and 31 connected in series to the full-wave rectification circuit 12 and the state in which the current is flowing with the first to third LED blocks 21 to 41 connected in series to the full-wave rectification circuit 12. There is therefore no need to specifically provide digital control circuitry for blocking the current flowing from the first and second LED blocks 21 and 31 directly to the full-wave rectification circuit 12.

Figure 5:
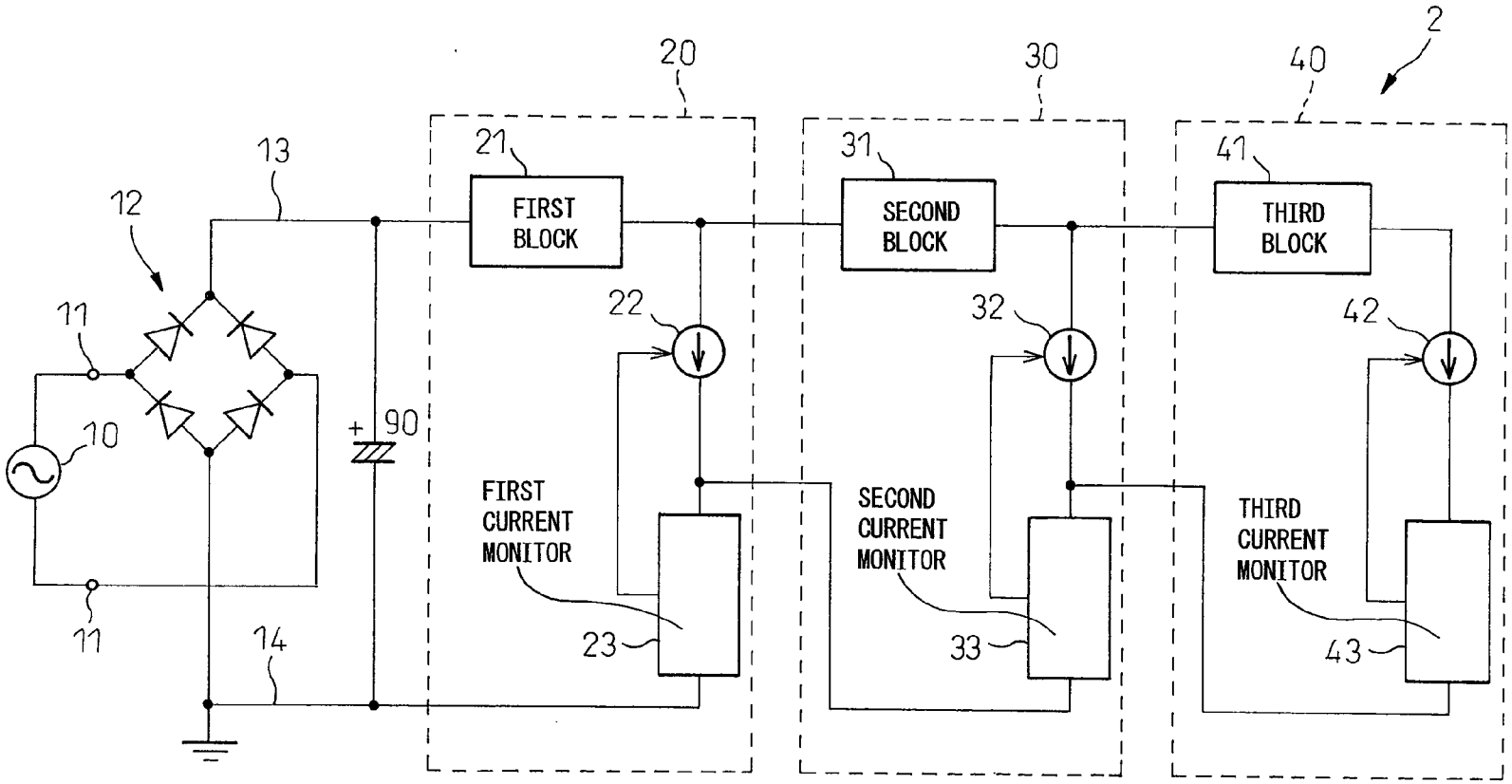
FIG. 5 is an explanatory schematic diagram of an alternative LED driving circuit 2.

FIG. 5 is an explanatory schematic diagram of an alternative LED driving circuit 2.

The LED driving circuit 2 shown in FIG. 5 differs from the LED driving circuit 1 shown in FIG. 1 only in that the LED driving circuit 2 includes an electrolytic capacitor 90 which is inserted between the output terminals of the full-wave rectification circuit 12.

The output voltage waveform of the full-wave rectification circuit 12 is smoothed by the electrolytic capacitor 90 (see voltage waveform 85 in FIG. 3(*a*)). In the case of the output voltage waveform 80 of the LED driving circuit 1 shown in FIG. 1, all the LEDs are OFF during the period from time T0 to time T1 and the period from time T6 to time T0 in the next cycle, because the output voltage is less than the first forward voltage V1. Accordingly, in the LED driving circuit 1 shown in FIG. 1, the LED-off period alternates with the LED-on period, which means that the LEDs are switched on and off at 100 Hz when the commercial power supply frequency is 50 Hz and at 120 Hz when the commercial power supply frequency is 60 Hz.

By contrast, in the LED driving circuit 2 shown in FIG. 5, since the output voltage waveform of the full-wave rectification circuit 12 is smoothed, the output voltage of the full-wave rectification circuit 12 is always higher than the first forward voltage V1, which means that at least the first LED block 21 is always ON. The LED driving circuit 2 shown in FIG. 5 can thus prevent the LEDs from switching on and off.

In the example of FIG. 5, the electrolytic capacitor 90 has been added, but instead of the electrolytic capacitor 90, use may be made of a ceramic capacitor or some other device or circuit for smoothing the output voltage waveform of the full-wave rectification circuit 12.

Figure 6:
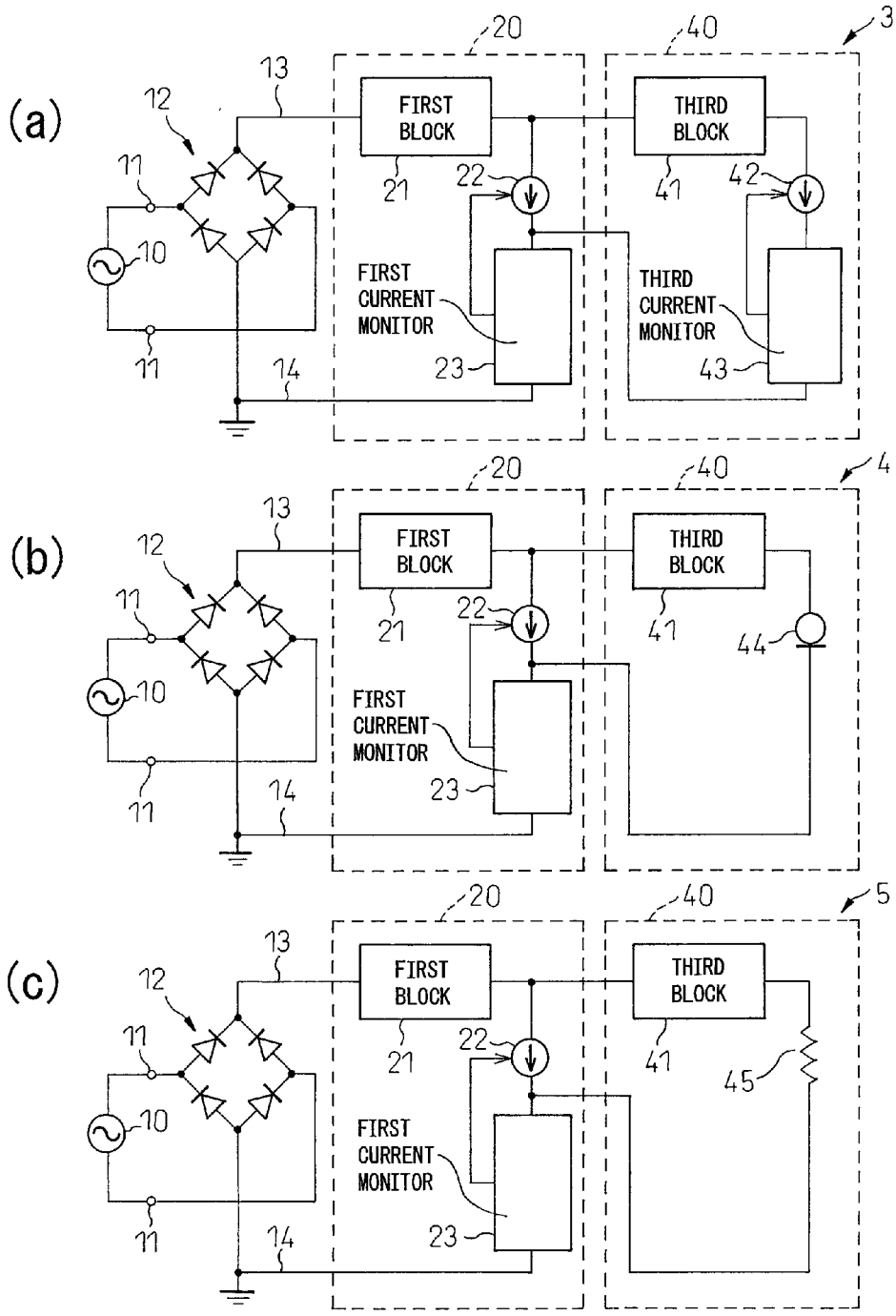
FIG. 6 is a diagram for explaining modified examples of the LED driving circuit.

FIG. 6 is a diagram for explaining modified examples of the LED driving circuit.

The LED driving circuits 1 and 2 have been described above for the case in which the LED driving circuit has three circuits, i.e., the first to third circuits 20 to 40. However, as shown in FIG. 6(*a*), the present invention is also applicable to an LED driving circuit 3 that has only two circuits, i.e., the first circuit 20 and the third circuit 40.

In the LED driving circuit 3 shown in FIG. 6(*a*), the first current monitor 23, upon detecting the current flowing through the third LED block 41 to the first current monitor 23, operates the first current limiting unit 22 so as to block the current flowing from the first LED block 21 to the negative output 14 of the full-wave rectification circuit 12, and thereby effects switching from the current path in which only the first LED block 21 is connected to the full-wave rectification circuit 12 to the current path in which the first and third LED blocks 21 and 41 are connected in series to the full-wave rectification circuit 12.

Further, as shown in FIG. 6(*b*), the present invention is also applicable to an LED driving circuit 4 in which the third current limiting unit 32 and third current monitor 43 in the third circuit 40 are replaced by a current regulative diode 44. The current regulative diode 44 acts to prevent overcurrent from flowing through the first and third LED blocks 21 and 41 when the current path is formed that connects the first and third LED blocks 21 and 41 in series to the full-wave rectification circuit 12.

Furthermore, as shown in FIG. 6(*c*), the present invention is also applicable to an LED driving circuit 5 in which the third current limiting unit 32 and third current monitor 43 in the third circuit 40 are replaced by a current limiting resistor 45 having a resistance, for example, of 1 to 50 ohms. The resistor 45 limits the current so that overcurrent does not flow through the first and third LED blocks 21 and 41 when the current path is formed that connects the first and third LED blocks 21 and 41 in series to the full-wave rectification circuit 12.

Figure 7:
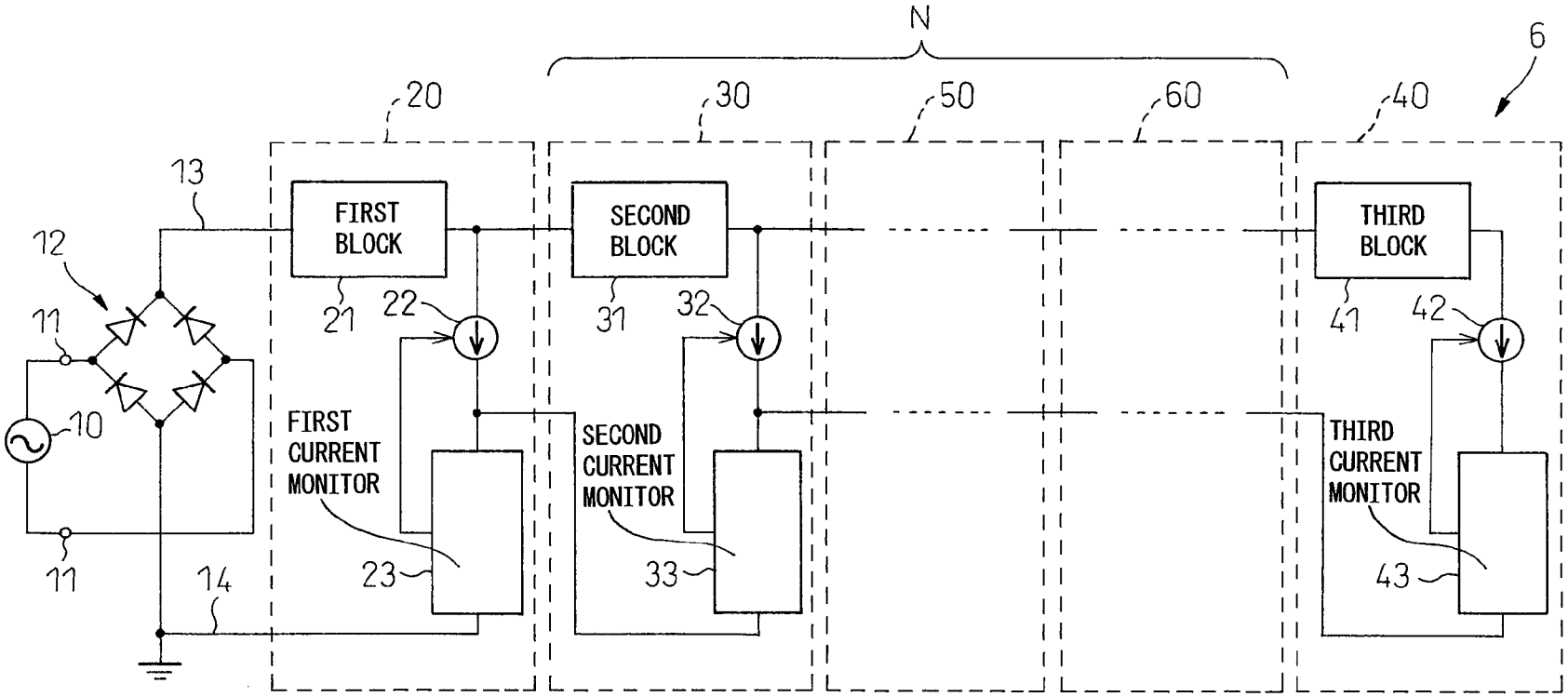
FIG. 7 is a diagram for explaining another modified example of the LED driving circuit.

FIG. 7 is a diagram for explaining another modified example of the LED driving circuit.

As shown in FIG. 7, the present invention is also applicable to an LED driving circuit 6 in which a plurality of intermediate circuits are provided between the first circuit 20 and the third circuit 40. The plurality of intermediate circuits include a fourth circuit 50 and a fifth circuit 60 in addition to the second circuit 30, and can be extended to include a total of N intermediate circuits. Each intermediate circuit, similarly to the earlier described second circuit 30, includes at least an LED array, a current limiting circuit, and a current monitor for controlling the current limiting circuit, and is connected in parallel with the current limiting unit 22 in the preceding circuit. With this arrangement, the plurality of LEDs can be blocked into (N+2) groups so that the respective groups can be controlled on and off by automatically switching from one to another in accordance with the supply voltage. The total number, n, of LEDs here is determined in the following manner. That is, when the number of LED blocks is N+2, the total number n is determined so that the voltage drop that occurs across the current limiting unit 42 when all the LEDs are connected in series is not larger than 1/(N+3) of the maximum output voltage of the full-wave rectification circuit 12. For example, when the number of LED blocks is eight, N=6 and, among the total numbers of LEDs that satisfy the condition $139\times8/9\leq n\times3.2$, 39 is desirable.

In the LED driving circuit 6, since the switching of the current path is automatically determined in accordance with the output voltage of the full-wave rectification circuit 12 and the sum of the actual Vf's of the individual LEDs contained in each LED block, the advantage is that the switching between the respective LED blocks can be made efficiently, even if the number of intermediate circuits is increased. Furthermore, if the number of LED blocks is increased, and thus the LED forward voltage of each LED block is reduced, it becomes possible to reduce the power loss that occurs in the current control unit constructed from the MOSFET.

Figure 8:
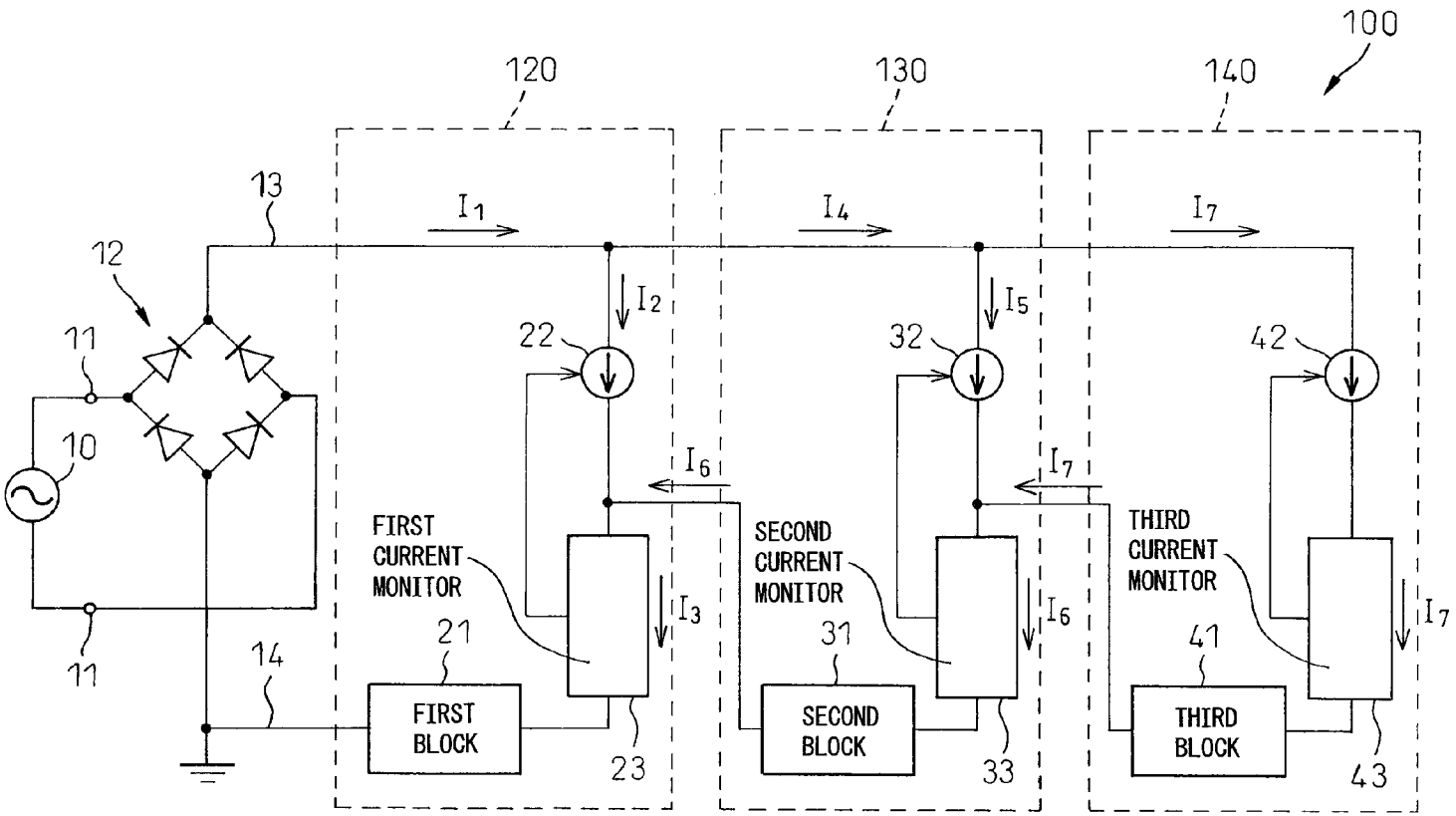
FIG. 8 is a diagram schematically illustrating the configuration of another alternative LED driving circuit 100.

FIG. 8 is an explanatory schematic diagram of another alternative LED driving circuit 100.

In the LED driving circuit 100 shown in FIG. 8, the same component elements as those in FIG. 1 are designated by the same reference numerals, and will not be further described herein. The LED driving circuit 100 comprises a pair of connecting terminals 11 for connection to an AC commercial power supply (100 VAC) 10, a full-wave rectification circuit 12, a first circuit 120, a second circuit 130, and a third circuit 140.

The LED driving circuit 100 shown in FIG. 8 differs from the LED driving circuit 1 shown in FIG. 1 in that the first LED block 21, which was connected between the first current limiting unit 22 and the positive output 13 of the full-wave rectification circuit 12 in the LED driving circuit 1, is connected between the first current monitor 23 and the negative output 14 of the full-wave rectification circuit 12 in the LED driving circuit 100. Likewise, the second LED block 31, which was connected between the first LED block 21 and the second current limiting unit 32 in the LED driving circuit 1, is connected between the first current monitor 23 and the second current monitor 33 in the LED driving circuit 100. Further, the third LED block 41, which was connected between the second LED block 31 and the third current limiting unit 42 in the LED driving circuit 1, is connected between the second current monitor 33 and the third current monitor 43 in the LED driving circuit 100.

In the above configuration, the first current monitor 23 detects the current flowing from the first LED block 21 to the negative output 14 of the full-wave rectification circuit 12.

An overview of the operation of the LED driving circuit 100 shown in FIG. 8 will be provided below.

When the output voltage of the full-wave rectification circuit 12 is 0 (v), since the voltage for causing any one of the first to third LED blocks 21 to 41 to emit light is not reached yet, the LEDs contained in any of the LED blocks remain OFF.

When the output voltage of the full-wave rectification circuit 12 reaches the voltage sufficient to cause the first LED block 21 to emit light, currents I1 to I3 begin to flow, causing the LEDs contained in the first LED block 21 to emit light. In this case, the output voltage of the full-wave rectification circuit 12 is sufficient to cause the first LED block 21 to emit light but falls short of the voltage for further causing the second and third LED blocks 31 and 41 to emit light; therefore, the currents I1 to I3 flow, but none of currents I4 to I7 flow because the voltage drop across the first current limiting unit 22 is low.

At this time, only the first LED block 21 is ON and, in this condition, when the output voltage of the full-wave rectification circuit 12 gradually rises, and the voltage drop across the first current control unit 22 nears the forward voltage of the second LED block 31 in the second circuit 130 connected in parallel therewith, the currents I4 to I6 begin to flow. However, since the output voltage is not high enough to cause the third LED block 41 to emit light, the current I7 does not flow. Here, since the current I3 increases due to the addition of the current I4 (=current I6), the first current monitor 23 monitoring the current I3 operates so as to limit (reduce) the current I2 by controlling the first current limiting unit 22, while on the other hand, the currents I1 and I3 are constantly maintained at the same value. Such operation is repeated when switching the current path, and the current I4 gradually increases while the current I2 gradually decreases. That is, the first current limiting unit 22 functions as a current limiting circuit that limits the current I2.

Next, when the output voltage of the full-wave rectification circuit 12 reaches the voltage sufficient to cause the first and second LED blocks 21 and 31 to emit light, a current path (I1, I4, I5, I6, and I3) is formed so as to connect the first and second LED blocks 21 and 31 in series relative to the full-wave rectification circuit 12, and the LEDs contained in the first and second LED blocks 21 and 31 emit light.

In this way, switching is automatically made from the state in which only the first LED block 21 is ON to the state in which the first and second LED blocks 21 and 31 are both ON. This switching is not performed by using a control signal, etc. by presetting the switching voltage for each LED block. Rather, the operation is performed automatically to switch the current path when the voltage drop across the first current limiting unit 22 nears the forward voltage of the second LED block 31 in the second circuit 130 connected in parallel therewith. More specifically, in the illustrated example, when the output voltage of the full-wave rectification circuit 12 rises up to the voltage equal to the sum of the Vf's of the LEDs contained in the respective LED blocks, switching is automatically made from the current path in which only the first LED block 21 is ON to the current path in which the first and second LED blocks 21 and 31 are both ON.

Both the first and second LED blocks 21 and 31 are now ON and, in this condition, when the output voltage of the full-wave rectification circuit 12 gradually rises, and the voltage drop across the second current control unit 32 nears the forward voltage of the third LED block 41 in the third circuit 140 connected in parallel therewith, the current I7 begins to flow. Here, since the current I6 increases due to the addition of the current I7, the second current monitor 33 monitoring the current I6 operates so as to limit (reduce) the current I5 by controlling the second current limiting unit 32, while on the other hand, the currents I4 and I6 are constantly maintained at the same value. Such operation is repeated when switching the current path, and the current I7 gradually increases while the current I5 gradually decreases. That is, the second current limiting unit 32 functions as a current limiting circuit that limits the current I5.

Next, when the output voltage reaches the voltage sufficient to cause the first to third LED blocks 21 to 41 to emit light, a current path (I1, I4, I7, I6, and I3) is formed so as to connect the first to third LED blocks 21 to 41 in series relative to the full-wave rectification circuit 12, and the LEDs contained in the first to third LED blocks 21 to 41 emit light.

In this way, switching is automatically made from the state in which the first and second LED blocks 21 and 31 are ON to the state in which all of the first to third LED blocks 21 to 41 are ON. This switching is not performed by using a control signal, etc. by presetting the switching voltage for each LED block, but is performed automatically when the output voltage of the full-wave rectification circuit 12 rises up to the voltage equal to the sum of the Vf's of the LEDs contained in the respective LED blocks.

As described above, while the LED driving circuit 100 differs from the LED driving circuit 1 of FIG. 1 in the positions of the first, second, and third LED blocks 21, 31, and 41, the LED driving circuit 100 also is configured so that the current path is switched in accordance with the output voltage of the full-wave rectification circuit 12. Furthermore, since the switching of the current path is automatically determined in accordance with the output voltage of the full-wave rectification circuit 12 and the sum of the actual Vf's of the individual LEDs contained in each LED block, there is no need to perform control by predicting the switching timing of each LED block from the number of LEDs contained in the LED block, and it thus becomes possible to switch the connection between the respective LED blocks with the most efficient timing.

In the LED driving circuit 100, as in the case of the LED driving circuit 2 shown FIG. 5, a smoothing circuit, such as the electrolytic capacitor 90, may be inserted between the output terminals of the full-wave rectification circuit 12. Further, the LED driving circuit 100 may be constructed from only the first and third circuit 120 and 140 by omitting the second circuit 130, as in the case of FIG. 6(*a*). Furthermore, in the LED driving circuit 100, the third current limiting unit 32 and third current monitor 43 in the third circuit 140 may be replaced by the current regulative diode 44 or the current limiting resistor 45 as shown in FIG. 6(*b*) or 6(*c*). Further, in the LED driving circuit 100, a plurality of intermediate circuits each having the same configuration as the second circuit 130 may be provided between the first circuit 120 and the third circuit 140, as shown in FIG. 7.

Figure 9:
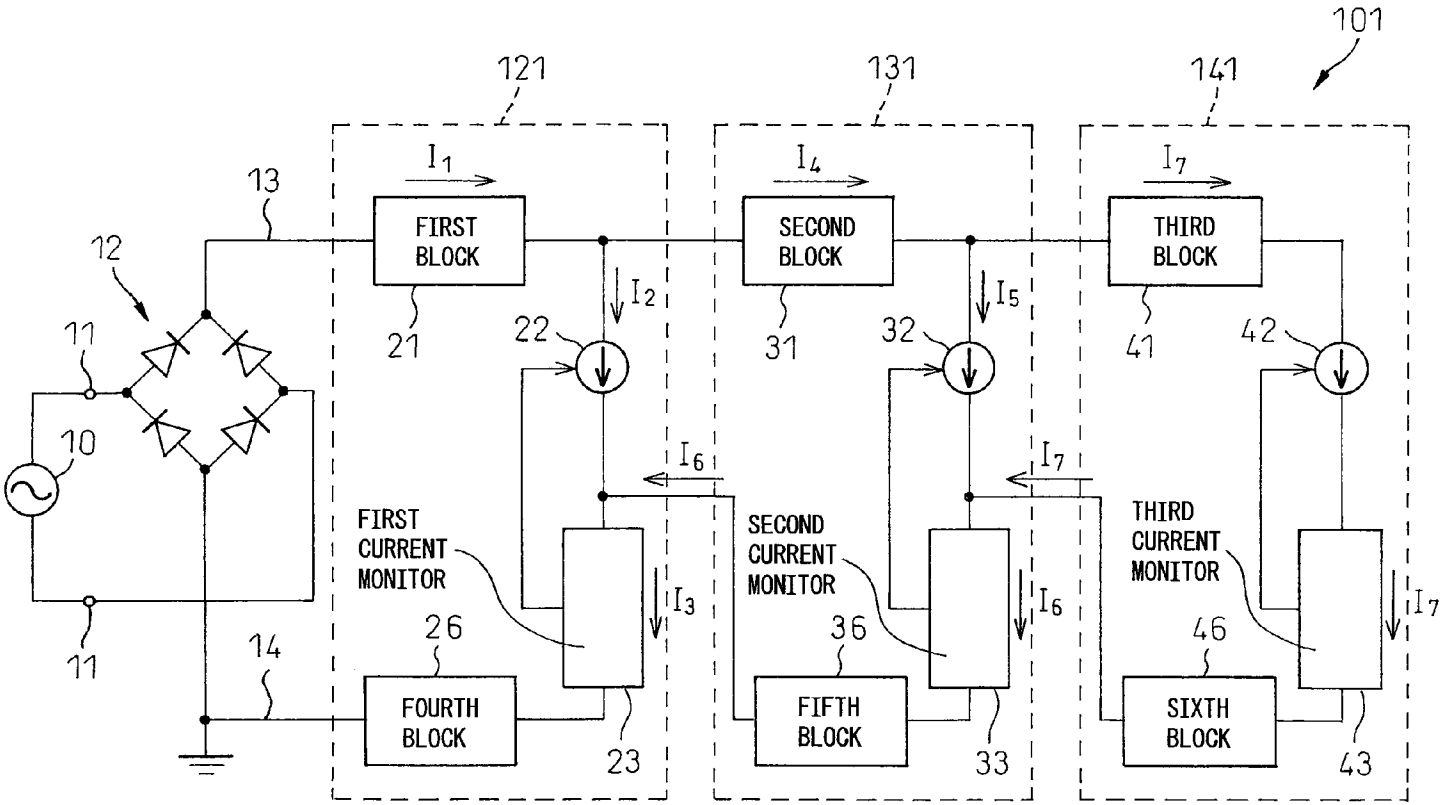
FIG. 9 is a diagram schematically illustrating the configuration of still another alternative LED driving circuit 101.

FIG. 9 is an explanatory schematic diagram of still another alternative LED driving circuit 101.

In the LED driving circuit 101 shown in FIG. 9, the same component elements as those in FIG. 1 are designated by the same reference numerals, and will not be further described herein. The LED driving circuit 101 comprises a pair of connecting terminals 11 for connection to an AC commercial power supply (100 VAC) 10, a full-wave rectification circuit 12, a first circuit 121, a second circuit 131, and a third circuit 141.

The LED driving circuit 101 shown in FIG. 9 is the same as the LED driving circuit 1 shown in FIG. 1 in that the first LED block 21 is connected between the first current limiting unit 22 and the positive output 13 of the full-wave rectification circuit 12, but differs in that a fourth LED block 26 is added between the first current monitor 23 and the negative output 14 of the full-wave rectification circuit 12. Likewise, in the LED driving circuit 101, the second LED block 31 is connected between the first LED block 21 and the second current limiting unit 32, while a fifth LED block 36 is added between the first current monitor 23 and the second current monitor 33. Further, in the LED driving circuit 101, the third LED block 41 is connected between the second LED block 31 and the third current limiting unit 42, while a sixth LED block 46 is added between the second current monitor 33 and the third current monitor 43.

An overview of the operation of the LED driving circuit 101 shown in FIG. 9 will be provided below.

When the output voltage of the full-wave rectification circuit 12 is 0 (v), since the voltage for causing any one of the first to sixth LED blocks 21 to 46 to emit light is not reached yet, the LEDs contained in any of the LED blocks remain OFF.

When the output voltage of the full-wave rectification circuit 12 reaches the voltage sufficient to cause the first and fourth LED blocks 21 and 26 to emit light, currents I1 to I3 begin to flow, causing the LEDs contained in the first and fourth LED blocks 21 and 26 to emit light. In this case, the output voltage of the full-wave rectification circuit 12 is sufficient to cause the first and fourth LED blocks 21 and 26 to emit light but falls short of the voltage for further causing the second, third, fifth, and sixth LED blocks 31, 41, 36, and 46 to emit light; therefore, the currents I1 to I3 flow, but none of currents I4 to I7 flow because the voltage drop across the first current limiting unit 22 is low.

At this time, the first and fourth LED block 21 and 26 are both ON and, in this condition, when the output voltage of the full-wave rectification circuit 12 gradually rises, and the voltage drop across the first current control unit 22 nears the combined forward voltage of the second and fifth LED blocks 31 and 36 in the second circuit 131 connected in parallel therewith, the currents I4 to I6 begin to flow. However, since the output voltage is not high enough to cause the third and sixth LED blocks 41 and 46 to emit light, the current I7 does not flow. Here, since the current I3 increases due to the addition of the current I4 (=current I6), the first current monitor 23 monitoring the current I3 operates so as to limit (reduce) the current I2 by controlling the first current limiting unit 22, while on the other hand, the currents I1 and I3 are constantly maintained at the same value. Such operation is repeated when switching the current path, and the current I4 gradually increases while the current I2 gradually decreases. That is, the first current limiting unit 22 functions as a current limiting circuit that limits the current I2.

Next, when the output voltage of the full-wave rectification circuit 12 reaches the voltage sufficient to cause the first, second, fourth, and fifth LED blocks 21, 31, 26, and 36 to emit light, a current path (I1, I4, I5, I6, and I3) is formed so as to connect the first, second, fourth, and fifth LED blocks 21, 31, 26, and 36 in series relative to the full-wave rectification circuit 12, and the LEDs contained in the first, second, fourth, and fifth LED blocks 21, 31, 26, and 36 emit light.

In this way, switching is automatically made from the state in which the first and fourth LED blocks 21 and 26 are ON to the state in which the first, second, fourth, and fifth LED blocks 21, 31, 26, and 36 are ON. This switching is not performed by using a control signal, etc. by presetting the switching voltage for each LED block. Rather, the operation is performed automatically to switch the current path when the voltage drop across the first current limiting unit 22 nears the combined forward voltage of the second and fifth LED blocks 31 and 36 in the second circuit 131 connected in parallel therewith. More specifically, in the illustrated example, when the output voltage of the full-wave rectification circuit 12 rises up to the voltage equal to the sum of the Vf's of the LEDs contained in the respective LED blocks, switching is automatically made from the current path in which the first and fourth LED blocks 21 and 26 are ON to the current path in which the first, second, fourth, and fifth LED blocks 21, 31, 26, and 36 are ON.

Thus, the first, second, fourth, and fifth LED blocks 21, 31, 26, and 36 are ON and, in this condition, when the output voltage of the full-wave rectification circuit 12 gradually rises, and the voltage drop across the second current control unit 32 nears the combined forward voltage of the third and sixth LED block 41 and 46 in the third circuit 141 connected in parallel therewith, the current I7 begins to flow. Here, since the current I6 increases due to the addition of the current I7, the second current monitor 33 monitoring the current I6 operates so as to limit (reduce) the current I5 by controlling the second current limiting unit 32, while on the other hand, the currents I4 and I6 are constantly maintained at the same value. Such operation is repeated when switching the current path, and the current I7 gradually increases while the current I5 gradually decreases. That is, the second current limiting unit 32 functions as a current limiting circuit that limits the current I5.

Next, when the output voltage reaches the voltage sufficient to cause the first to sixth LED blocks 21 to 46 to emit light, a current path (I1, I4, I7, I6, and I3) is formed so as to connect the first to sixth LED blocks 21 to 46 in series relative to the full-wave rectification circuit 12, and the LEDs contained in the first to sixth LED blocks 21 to 46 emit light.

In this way, switching is automatically made from the state in which the first, second, fourth, and fifth LED blocks 21, 31, 26, and 36 are ON to the state in which all of the first to sixth LED blocks 21 to 46 are ON. This switching is not performed by using a control signal, etc. by presetting the switching voltage for each LED block, but is performed automatically when the output voltage of the full-wave rectification circuit 12 rises up to the voltage equal to the sum of the Vf's of the LEDs contained in the respective LED blocks.

As described above, while the LED driving circuit 101 differs from the LED driving circuit 1 of FIG. 1 by the inclusion of the fourth, fifth, and sixth LED blocks 26, 36, and 46, the LED driving circuit 101 also is configured so that the current path is switched in accordance with the output voltage of the full-wave rectification circuit 12. Furthermore, since the switching of the current path is automatically determined in accordance with the output voltage of the full-wave rectification circuit 12 and with the sum of the actual Vf's of the individual LEDs contained in the first and fourth LED blocks 21 and 26, the sum of the actual Vf's of the individual LEDs contained in the second and fifth LED blocks 31 and 36, or the sum of the actual Vf's of the individual LEDs contained in the third and sixth LED blocks 41 and 46, there is no need to perform control by predicting the switching timing of each LED block from the number of LEDs contained in the LED block, and it thus becomes possible to switch the connection between the respective LED blocks with the most efficient timing.

In the LED driving circuit 101, as in the case of the LED driving circuit 2 shown FIG. 5, a smoothing circuit, such as the electrolytic capacitor 90, may be inserted between the output terminals of the full-wave rectification circuit 12. Further, the LED driving circuit 101 may be constructed from only the first and third circuit 121 and 141 by omitting the second circuit 131, as in the case of FIG. 6(*a*). Furthermore, in the LED driving circuit 101, the third current limiting unit 32 and third current monitor 43 in the third circuit 141 may be replaced by the current regulative diode 44 or the current limiting resistor 45 as shown in FIG. 6(*b*) or 6(*c*). Further, in the LED driving circuit 101, a plurality of intermediate circuits each having the same configuration as the second circuit 131 may be provided between the first circuit 121 and the third circuit 141, as shown in FIG. 7.

Figure 10:
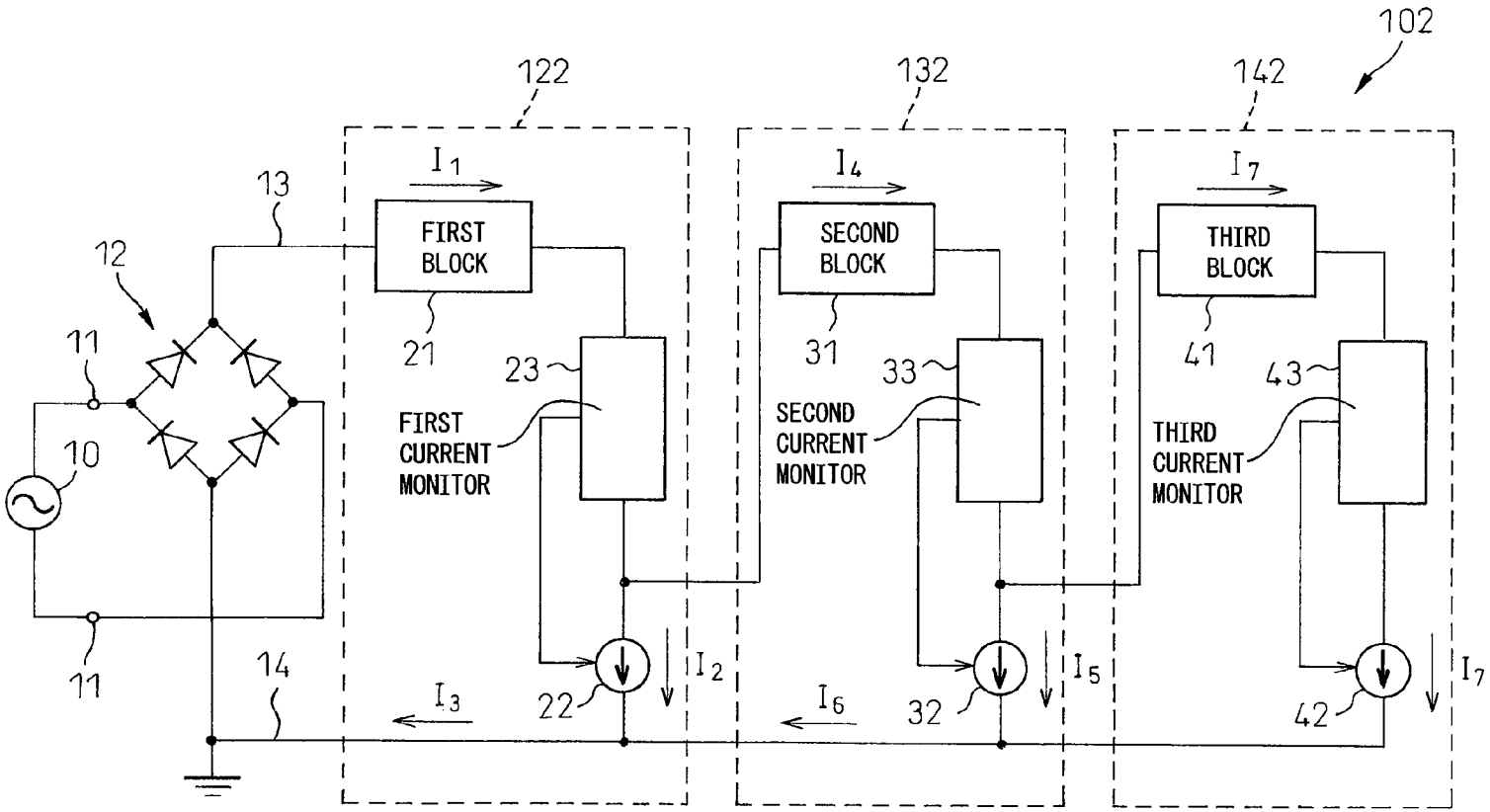
FIG. 10 is a diagram schematically illustrating the configuration of yet another alternative LED driving circuit 102.

FIG. 10 is an explanatory schematic diagram of yet another alternative LED driving circuit 102.

In the LED driving circuit 102 shown in FIG. 10, the same component elements as those in FIG. 1 are designated by the same reference numerals, and will not be further described herein. The LED driving circuit 102 comprises a pair of connecting terminals 11 for connection to an AC commercial power supply (100 VAC) 10, a full-wave rectification circuit 12, a first circuit 122, a second circuit 132, and a third circuit 142.

The LED driving circuit 102 shown in FIG. 10 differs from the LED driving circuit 1 shown in FIG. 1 in that, in the first circuit 122, the first current monitor 23 and the first current limiting circuit 22 are interchanged in position so that the first LED block 21 is connected between the first current monitor 23 and the positive output 13 of the full-wave rectification circuit 12 and the first current limiting circuit 22 is connected to the negative output 14 of the full-wave rectification circuit 12. Likewise, in the second circuit 132, the second current monitor 33 and the second current limiting circuit 32 are interchanged in position so that the second LED block 31 is connected between the first current monitor 23 and the second current monitor 33 and the second current limiting circuit 32 is connected to the negative output 14 of the full-wave rectification circuit 12. Further, in the third circuit 142, the third current monitor 43 and the third current limiting circuit 42 are interchanged in position so that the third LED block 41 is connected between the second current monitor 33 and the third current monitor 43 and the third current limiting circuit 42 is connected to the negative output 14 of the full-wave rectification circuit 12.

An overview of the operation of the LED driving circuit 102 shown in FIG. 10 will be provided below.

When the output voltage of the full-wave rectification circuit 12 is 0 (v), since the voltage for causing any one of the first to third LED blocks 21 to 41 to emit light is not reached yet, the LEDs contained in any of the LED blocks remain OFF.

When the output voltage of the full-wave rectification circuit 12 reaches the voltage sufficient to cause the first LED block 21 to emit light, currents I1 to I3 begin to flow, causing the LEDs contained in the first LED block 21 to emit light. In this case, the output voltage of the full-wave rectification circuit 12 is sufficient to cause the first LED block 21 to emit light but falls short of the voltage for further causing the second and third LED blocks 31 and 41 to emit light; therefore, the currents I1 to I3 flow, but none of currents I4 to I7 flow.

At this time, only the first LED block 21 is ON and, in this condition, when the output voltage of the full-wave rectification circuit 12 gradually rises, and the voltage drop across the first current limiting unit 22 nears the forward voltage of the second LED block 31 in the second circuit 132 connected in parallel therewith, the currents I4 to I6 begin to flow. However, since the output voltage is not high enough, the current I7 does not flow. Here, since the current I2 decreases by an amount equal to the current I4 (=current I6), the first current monitor 23 monitoring the current I1 operates so as to limit (reduce) the current I2 by controlling the first current limiting unit 22. The current I3 at this time is equal to the sum of the currents I2 and I6 (=I4), that is, the currents I1 and I3 are constantly maintained at the same value. Such operation is repeated when switching the current path, and the current I4 gradually increases while the current I2 gradually decreases. That is, the first current limiting unit 22 functions as a current limiting circuit that limits the current I3.

Next, when the output voltage of the full-wave rectification circuit 12 reaches the voltage sufficient to cause the first and second LED blocks 21 and 31 to emit light, a current path (I1, I4, I5, I6, and I3) is formed so as to connect the first and second LED blocks 21 and 31 in series relative to the full-wave rectification circuit 12, and the LEDs contained in the first and second LED blocks 21 and 31 emit light.

In this way, switching is automatically made from the state in which only the first LED block 21 is ON to the state in which the first and second LED blocks 21 and 31 are both ON. This switching is not performed by using a control signal, etc. by presetting the switching voltage for each LED block. Rather, the operation is performed automatically to switch the current path when the voltage drop across the first current limiting unit 22 nears the forward voltage of the second LED block in the second circuit 132 connected in parallel therewith. More specifically, in the illustrated example, when the output voltage of the full-wave rectification circuit 12 rises up to the voltage equal to the sum of the Vf's of the LEDs contained in the respective LED blocks, switching is automatically made from the current path in which only the first LED block 21 is ON to the current path in which the first and second LED blocks 21 and 31 are both ON.

Both the first and second LED blocks 21 and 31 are now ON and, in this condition, when the output voltage of the full-wave rectification circuit 12 gradually rises, and the voltage drop across the second current control unit 32 nears the forward voltage of the third LED block 41 in the third circuit 142 connected in parallel therewith, the current I7 begins to flow. Here, since the current I5 decreases by an amount equal to the current I7, the second current monitor 33 monitoring the current I4 operates so as to limit (reduce) the current I5 by controlling the second current limiting unit 32, but since the current I6 is equal to the sum of the currents I5 and I7, the currents I4 and I6 are constantly maintained at the same value. Such operation is repeated when switching the current path, and the current I7 gradually increases while the current I5 gradually decreases. That is, the second current limiting unit 32 functions as a current limiting circuit that limits the current I5.

Next, when the output voltage reaches the voltage sufficient to cause the first to third LED blocks 21 to 41 to emit light, a current path (I1, I4, I7, I6, and I3) is formed so as to connect the first to third LED blocks 21 to 41 in series relative to the full-wave rectification circuit 12, and the LEDs contained in the first to third LED blocks 21 to 41 emit light.

In this way, switching is automatically made from the state in which the first and second LED blocks 21 and 31 are ON to the state in which all of the first to third LED blocks 21 to 41 are ON. This switching is not performed by using a control signal, etc. by presetting the switching voltage for each LED block, but is performed automatically when the output voltage of the full-wave rectification circuit 12 rises up to the voltage equal to the sum of the Vf's of the LEDs contained in the respective LED blocks.

As described above, the LED driving circuit 102, similarly to the LED driving circuit 1 of FIG. 1, is configured so that the current path is switched in accordance with the output voltage of the full-wave rectification circuit 12. Furthermore, since the switching of the current path is automatically determined in accordance with the output voltage of the full-wave rectification circuit 12 and the sum of the actual Vf's of the individual LEDs contained in each LED block, there is no need to perform control by predicting the switching timing of each LED block from the number of LEDs contained in the LED block, and it thus becomes possible to switch the connection between the respective LED blocks with the most efficient timing.

In the LED driving circuit 102, as in the case of the LED driving circuit 2 shown FIG. 5, a smoothing circuit, such as the electrolytic capacitor 90, may be inserted between the output terminals of the full-wave rectification circuit 12. Further, the LED driving circuit 102 may be constructed from only the first and third circuit 122 and 142 by omitting the second circuit 132, as in the case of FIG. 6(*a*). Furthermore, in the LED driving circuit 102, the third current limiting unit 32 and third current monitor 43 in the third circuit 142 may be replaced by the current regulative diode 44 or the current limiting resistor 45 as shown in FIG. 6(*b*) or 6(*c*). Further, in the LED driving circuit 102, a plurality of intermediate circuits each having the same configuration as the second circuit 132 may be provided between the first circuit 122 and the third circuit 142, as shown in FIG. 7.

Figure 11:
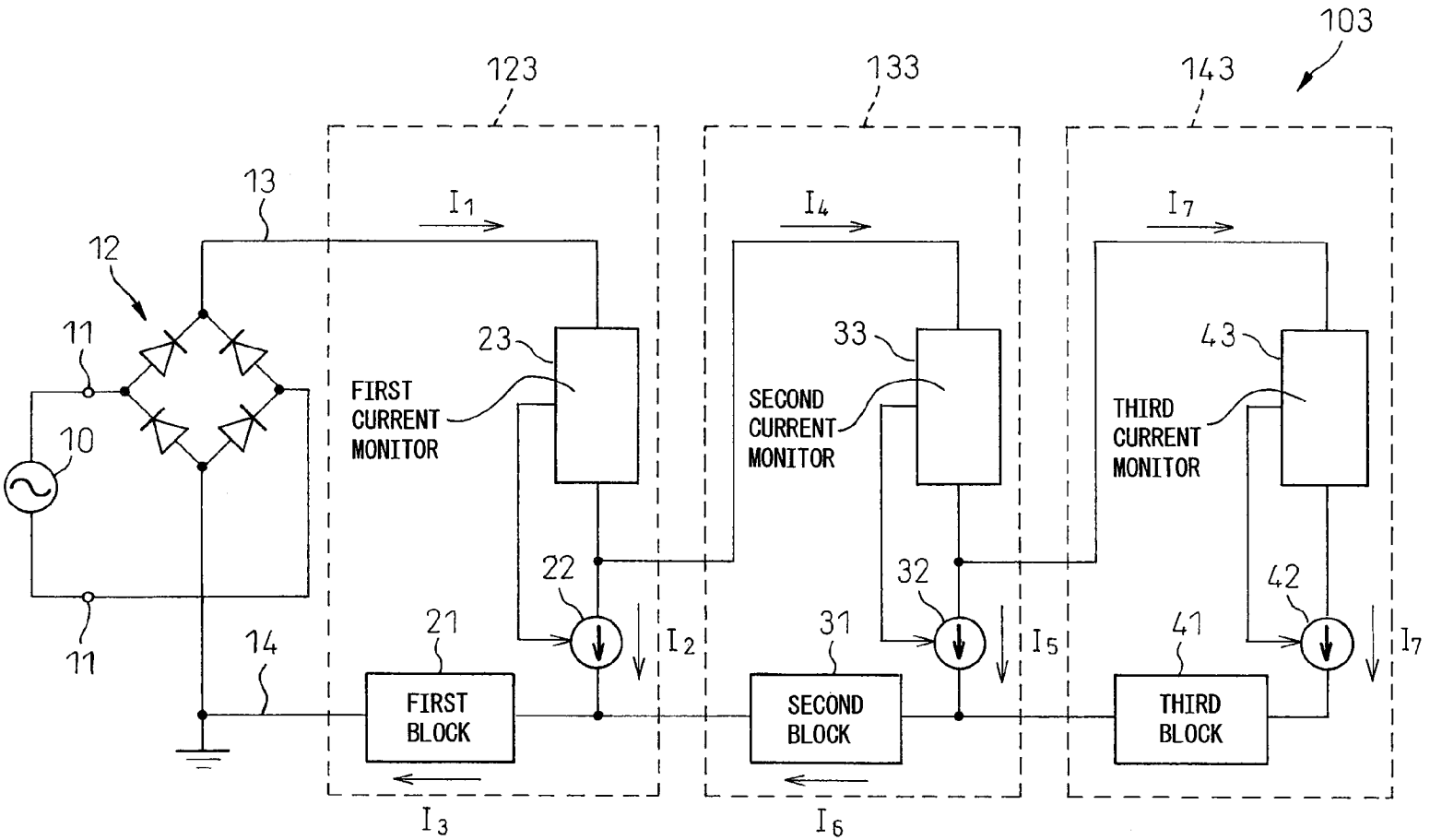
FIG. 11 is a diagram schematically illustrating the configuration of a further alternative LED driving circuit 103.

FIG. 11 is an explanatory schematic diagram of a further alternative LED driving circuit 103.

In the LED driving circuit 103 shown in FIG. 11, the same component elements as those in FIG. 10 are designated by the same reference numerals, and will not be further described herein. The LED driving circuit 103 comprises a pair of connecting terminals 11 for connection to an AC commercial power supply (100 VAC) 10, a full-wave rectification circuit 12, a first circuit 123, a second circuit 133, and a third circuit 143.

The LED driving circuit 103 shown in FIG. 11 differs from the LED driving circuit 102 shown in FIG. 10 in that, in the first circuit 123, the first LED block 21 is connected between the first current limiting unit 22 and the negative output 14 of the full-wave rectification circuit 12. Likewise, the second LED block 31 is connected between the first LED block 21 and the second current limiting unit 32. Further, the third LED block 41 is connected between the second LED block 31 and the third current limiting unit 42.

An overview of the operation of the LED driving circuit 103 shown in FIG. 11 will be provided below.

When the output voltage of the full-wave rectification circuit 12 is 0 (v), since the voltage for causing any one of the first to third LED blocks 21 to 41 to emit light is not reached yet, the LEDs contained in any of the LED blocks remain OFF.

When the output voltage of the full-wave rectification circuit 12 reaches the voltage sufficient to cause the first LED block 21 to emit light, currents I1 to I3 begin to flow, causing the LEDs contained in the first LED block 21 to emit light. In this case, the output voltage of the full-wave rectification circuit 12 is sufficient to cause the first LED block 21 to emit light but falls short of the voltage for further causing the second and third LED blocks 31 and 41 to emit light; therefore, the currents I1 to I3 flow, but none of currents I4 to I7 flow.

At this time, only the first LED block 21 is ON and, in this condition, when the output voltage of the full-wave rectification circuit 12 gradually rises, and the voltage drop across the first current control unit 22 nears the forward voltage of the second LED block 31 in the second circuit 133 connected in parallel therewith, the currents I4 to I6 begin to flow. However, since the output voltage is not high enough, the current I7 does not flow. At this time, the current I1 is equal to the sum of the currents I2 and I4. Further, the current I3 is also equal to the sum of the currents I2 and I6 (=I4), that is, the currents I1 and I3 are constantly maintained at the same value. The first current monitor 23 monitors the current I1 and operates so as to limit (reduce) the current I2 by an amount equal to the current I4 (=current I6). Such operation is repeated when switching the current path, and the current I4 gradually increases while the current I2 gradually decreases. That is, the first current limiting unit 22 functions as a current limiting circuit that limits the current I2.

Next, when the output voltage of the full-wave rectification circuit 12 reaches the voltage sufficient to cause the first and second LED blocks 21 and 31 to emit light, a current path (I1, I4, I5, I6, and I3) is formed so as to connect the first and second LED blocks 21 and 31 in series relative to the full-wave rectification circuit 12, and the LEDs contained in the first and second LED blocks 21 and 31 emit light.

In this way, switching is automatically made from the state in which only the first LED block 21 is ON to the state in which the first and second LED blocks 21 and 31 are both ON. This switching is not performed by using a control signal, etc. by presetting the switching voltage for each LED block. Rather, the operation is performed automatically to switch the current path when the voltage drop across the first current limiting unit 22 nears the forward voltage of the second LED block 31 in the second circuit 133 connected in parallel therewith. More specifically, in the illustrated example, when the output voltage of the full-wave rectification circuit 12 rises up to the voltage equal to the sum of the Vf's of the LEDs contained in the respective LED blocks, switching is automatically made from the current path in which only the first LED block 21 is ON to the current path in which the first and second LED blocks 21 and 31 are both ON.

Both the first and second LED blocks 21 and 31 are now ON and, in this condition, when the output voltage of the full-wave rectification circuit 12 gradually rises, and the voltage drop across the second current control unit 32 nears the forward voltage of the third LED block 41 in the third circuit 143 connected in parallel therewith, the current I7 begins to flow. Here, since the current I5 decreases by an amount equal to the current I7, the second current monitor 33 monitoring the current I4 operates so as to limit (reduce) the current I5 by controlling the second current limiting unit 32, but since the current I6 is equal to the sum of the currents I5 and I7, the currents I4 and I6 are constantly maintained at the same value. Such operation is repeated when switching the current path, and the current I7 gradually increases while the current I5 gradually decreases. That is, the second current limiting unit 32 functions as a current limiting circuit that limits the current I5.

Next, when the output voltage reaches the voltage sufficient to cause the first to third LED blocks 21 to 41 to emit light, a current path (I1, I4, I7, I6, and I3) is formed so as to connect the first to third LED blocks 21 to 41 in series relative to the full-wave rectification circuit 12, and the LEDs contained in the first to third LED blocks 21 to 41 emit light.

In this way, switching is automatically made from the state in which the first and second LED blocks 21 and 31 are ON to the state in which all of the first to third LED blocks 21 to 41 are ON. This switching is not performed by using a control signal, etc. by presetting the switching voltage for each LED block, but is performed automatically when the output voltage of the full-wave rectification circuit 12 rises up to the voltage equal to the sum of the Vf's of the LEDs contained in the respective LED blocks.

As described above, while the LED driving circuit 103 differs from the LED driving circuit 102 of FIG. 10 in the positions of the first, second, and third LED blocks 21, 31, and 41, the LED driving circuit 103 also is configured so that the current path is switched in accordance with the output voltage of the full-wave rectification circuit 12. Furthermore, since the switching of the current path is automatically determined in accordance with the output voltage of the full-wave rectification circuit 12 and the sum of the actual Vf's of the individual LEDs contained in each LED block, there is no need to perform control by predicting the switching timing of each LED block from the number of LEDs contained in the LED block, and it thus becomes possible to switch the connection between the respective LED blocks with the most efficient timing.

In the LED driving circuit 103, as in the case of the LED driving circuit 2 shown FIG. 5, a smoothing circuit, such as the electrolytic capacitor 90, may be inserted between the output terminals of the full-wave rectification circuit 12. Further, the LED driving circuit 103 may be constructed from only the first and third circuit 123 and 143 by omitting the second circuit 133, as in the case of FIG. 6(*a*). Furthermore, in the LED driving circuit 103, the third current limiting unit 32 and third current monitor 43 in the third circuit 143 may be replaced by the current regulative diode 44 or the current limiting resistor 45 as shown in FIG. 6(*b*) or 6(*c*). Further, in the LED driving circuit 103, a plurality of intermediate circuits each having the same configuration as the second circuit 133 may be provided between the first circuit 123 and the third circuit 143, as shown in FIG. 7.

Figure 12:
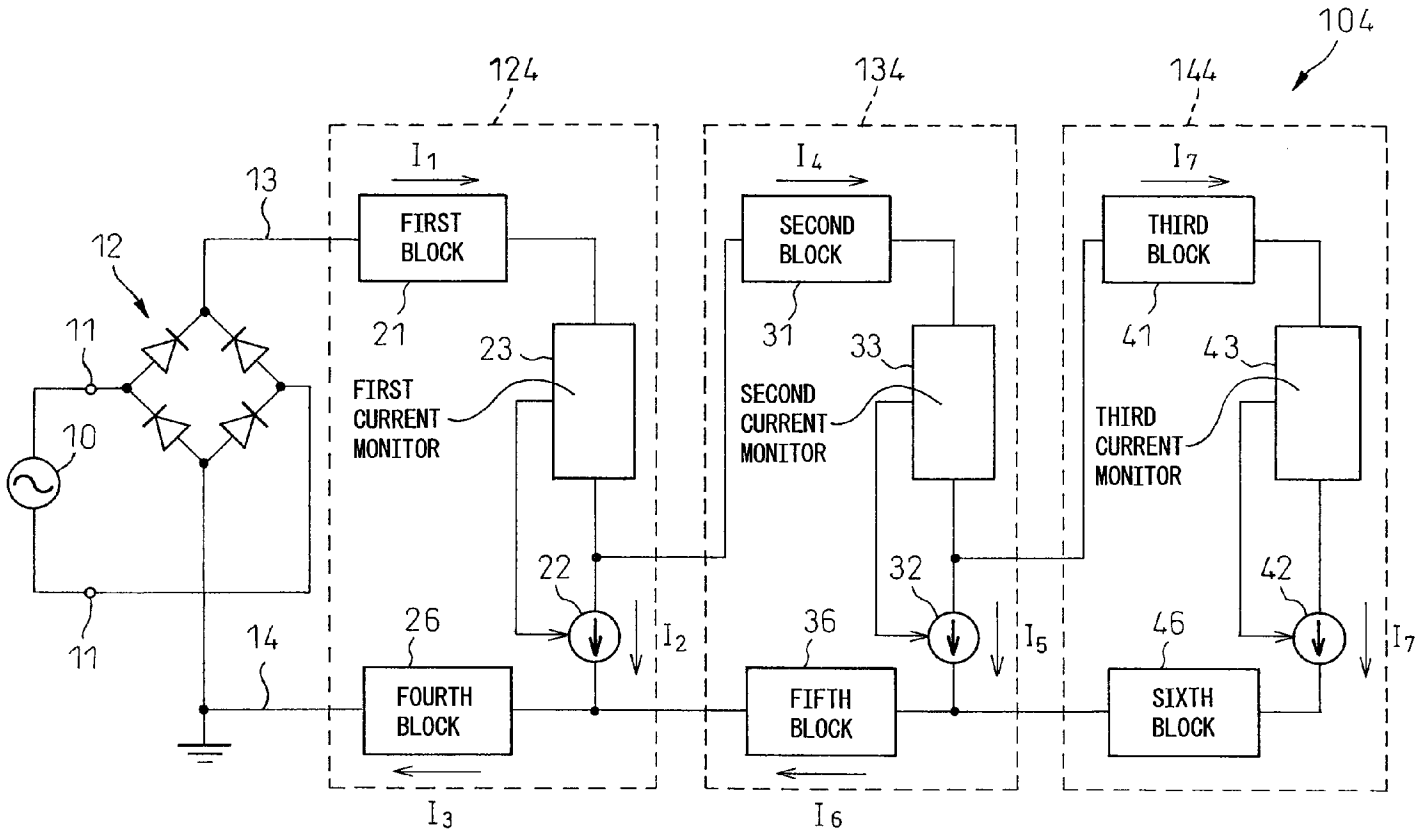
FIG. 12 is a diagram schematically illustrating the configuration of a still further alternative LED driving circuit 104.

FIG. 12 is an explanatory schematic diagram of a still further alternative LED driving circuit 104.

In the LED driving circuit 104 shown in FIG. 12, the same component elements as those in FIG. 10 are designated by the same reference numerals, and will not be further described herein. The LED driving circuit 104 comprises a pair of connecting terminals 11 for connection to an AC commercial power supply (100 VAC) 10, a full-wave rectification circuit 12, a first circuit 124, a second circuit 134, and a third circuit 144.

The LED driving circuit 104 shown in FIG. 12 is the same as the LED driving circuit 102 shown in FIG. 10 in that, in the first circuit 124, the first LED block 21 is connected between the first current monitor 23 and the positive output 13 of the full-wave rectification circuit 12, but differs in that a fourth LED block 26 is added between the first current control unit 22 and the negative output 14 of the full-wave rectification circuit 12. Likewise, in the second circuit 134, the second LED block 31 is connected between the first current monitor 23 and the second current monitor 33, while a fifth LED block 36 is added between the fourth LED block 26 and the second current limiting unit 32. Further, in the third circuit 144, the third LED block 41 is connected between the second current monitor 33 and the third current monitor 43, while a sixth LED block 46 is added between the fifth LED block 36 and the third current limiting unit 42.

An overview of the operation of the LED driving circuit 104 shown in FIG. 12 will be provided below.

When the output voltage of the full-wave rectification circuit 12 is 0 (v), since the voltage for causing any one of the first to sixth LED blocks 21 to 46 to emit light is not reached yet, the LEDs contained in any of the LED blocks remain OFF.

When the output voltage of the full-wave rectification circuit 12 reaches the voltage sufficient to cause the first and fourth LED blocks 21 and 26 to emit light, currents I1 to I3 begin to flow, causing the LEDs contained in the first and fourth LED blocks 21 and 26 to emit light. In this case, the output voltage of the full-wave rectification circuit 12 is sufficient to cause the first and fourth LED blocks 21 and 26 to emit light but falls short of the voltage for further causing the second, third, fifth, and sixth LED blocks 31, 41, 36, and 46 to emit light; therefore, the currents I1 to I3 flow, but none of currents I4 to I7 flow.

At this time, the first and fourth LED block 21 and 26 are both ON and, in this condition, when the output voltage of the full-wave rectification circuit 12 gradually rises, and the voltage drop across the first current control unit 22 nears the combined forward voltage of the second and fifth LED blocks 31 and 36 in the second circuit 134 connected in parallel therewith, the currents I4 to I6 begin to flow. However, since the output voltage is not high enough, the current I7 does not flow. At this time, the current I1 is equal to the sum of the currents I2 and I4. Further, the current I3 is equal to the sum of the currents I2 and I6 (=I4), that is, the currents I1 and I3 are constantly maintained at the same value. Since the current I2 decreases by an amount equal to the current I4 (=current I6), the first current monitor 23 monitoring the current I1 operates so as to limit (reduce) the current I2 by controlling the first current limiting unit 22. Such operation is repeated when switching the current path, and the current I4 gradually increases while the current I2 gradually decreases. That is, the first current limiting unit 22 functions as a current limiting circuit that limits the current I2.

Next, when the output voltage of the full-wave rectification circuit 12 reaches the voltage sufficient to cause the first, second, fourth, and fifth LED blocks 21, 31, 26, and 36 to emit light, a current path (I1, I4, I5, I6, and I3) is formed so as to connect the first, second, fourth, and fifth LED blocks 21, 31, 26, and 36 in series relative to the full-wave rectification circuit 12, and the LEDs contained in the first, second, fourth, and fifth LED blocks 21, 31, 26, and 36 emit light.

In this way, switching is automatically made from the state in which the first and fourth LED blocks 21 and 26 are ON to the state in which the first, second, fourth, and fifth LED blocks 21, 31, 26, and 36 are ON. This switching is not performed by using a control signal, etc. by presetting the switching voltage for each LED block. Rather, the operation is performed automatically to switch the current path when the voltage drop across the first current limiting unit 22 nears the combined forward voltage of the second and fifth LED blocks 31 and 36 in the second circuit 134 connected in parallel therewith. More specifically, in the illustrated example, when the output voltage of the full-wave rectification circuit 12 rises up to the voltage equal to the sum of the Vf's of the LEDs contained in the respective LED blocks, switching is automatically made from the current path in which the first and fourth LED blocks 21 and 26 are ON to the current path in which the first, second, fourth, and fifth LED blocks 21, 31, 26, and 36 are ON.

Thus, the first, second, fourth, and fifth LED blocks 21, 31, 26, and 36 are ON and, in this condition, when the output voltage of the full-wave rectification circuit 12 gradually rises, and the voltage drop across the second current control unit 32 nears the combined forward voltage of the third and sixth LED block 41 and 46 in the third circuit 144 connected in parallel therewith, the current I7 begins to flow. Here, since the current I5 decreases by an amount equal to the current I7, the second current monitor 33 monitoring the current I4 operates so as to limit (reduce) the current I5 by controlling the second current limiting unit 32. The current I6 at this time is equal to the sum of the currents I5 and I7, that is, the currents I4 and I6 are constantly maintained at the same value. Such operation is repeated when switching the current path, and the current I7 gradually increases while the current I5 gradually decreases. That is, the second current limiting unit 32 functions as a current limiting circuit that limits the current I5.

Next, when the output voltage reaches the voltage sufficient to cause the first to sixth LED blocks 21 to 46 to emit light, a current path (I1, I4, I7, I6, and I3) is formed so as to connect the first to sixth LED blocks 21 to 46 in series relative to the full-wave rectification circuit 12, and the LEDs contained in the first to sixth LED blocks 21 to 46 emit light.

In this way, switching is automatically made from the state in which the first, second, fourth, and fifth LED blocks 21, 31, 26, and 36 are ON to the state in which all of the first to sixth LED blocks 21 to 46 are ON. This switching is not performed by using a control signal, etc. by presetting the switching voltage for each LED block, but is performed automatically when the output voltage of the full-wave rectification circuit 12 rises up to the voltage equal to the sum of the Vf's of the LEDs contained in the respective LED blocks.

As described above, while the LED driving circuit 104 differs from the LED driving circuit 101 of FIG. 9 in that the current monitor and the current limiting circuit are interchanged in position, the LED driving circuit 104 also is configured so that the current path is switched in accordance with the output voltage of the full-wave rectification circuit 12. Furthermore, since the switching of the current path is automatically determined in accordance with the output voltage of the full-wave rectification circuit 12 and with the sum of the actual Vf's of the individual LEDs contained in the first and fourth LED blocks 21 and 26, the sum of the actual Vf's of the individual LEDs contained in the second and fifth LED blocks 31 and 36, or the sum of the actual Vf's of the individual LEDs contained in the third and sixth LED blocks 41 and 46, there is no need to perform control by predicting the switching timing of each LED block from the number of LEDs contained in the LED block, and it thus becomes possible to switch the connection between the respective LED blocks with the most efficient timing.

In the LED driving circuit 104, as in the case of the LED driving circuit 2 shown FIG. 5, a smoothing circuit, such as the electrolytic capacitor 90, may be inserted between the output terminals of the full-wave rectification circuit 12. Further, the LED driving circuit 104 may be constructed from only the first and third circuit 124 and 144 by omitting the second circuit 134, as in the case of FIG. 6(*a*). Furthermore, in the LED driving circuit 104, the third current limiting unit 32 and third current monitor 43 in the third circuit 144 may be replaced by the current regulative diode 44 or the current limiting resistor 45 as shown in FIG. 6(*b*) or 6(*c*). Further, in the LED driving circuit 104, a plurality of intermediate circuits each having the same configuration as the second circuit 134 may be provided between the first circuit 124 and the third circuit 144, as shown in FIG. 7.

Each of the LED driving circuits described above can be used in such applications as indoor LED lighting equipment such as an LED lamp, signboard lighting that uses LEDs as illumination units, road lighting, street lighting, traffic signal lighting, etc.

What is claimed is:

1. An LED driving circuit comprising:

a rectifier having a positive output and a negative output;

a first circuit which includes a first LED array connected to said rectifier, a first current detection unit for detecting current flowing from said first LED array to said negative output of said rectifier, and a first current limiting unit for limiting the current flowing from said first LED array to said negative output of said rectifier in accordance with said current detected by said first current detection unit; and a second circuit which includes a second LED array, a second current detection unit for detecting current flowing from said second LED array to said first current detection unit, and a second current limiting unit for limiting the current flowing from said second LED array to said first current detection unit, wherein said second current detection unit and said second current limiting unit are connected, together with said second LED array, in parallel with said first current limiting unit, a current path in which only said first LED array is connected to said rectifier and a current path in which said first LED array and said second LED array are connected in series relative to said rectifier are formed in accordance with an output voltage of said rectifier, and said first current detection unit, upon detecting current flowing through said first and second LED arrays, operates said first current limiting unit so as to effect switching to said current path in which said first LED array and said second LED array are connected in series relative to said rectifier.

2. The LED driving circuit according to claim 1, wherein said first current limiting unit blocks any current that flows from said first LED array to said negative output of said rectifier without passing through said second LED array.

3. The LED driving circuit according to claim 1, wherein said first current limiting unit blocks any current that flows from said positive output of said rectifier to said first LED array without passing through said second LED array.

4. The LED driving circuit according to claim 1, further comprising an intermediate circuit which is connected between said first circuit and said second circuit, and which includes a third LED array, a third current detection unit for detecting current flowing from said third LED array to said negative output of said rectifier, and a third current limiting unit for limiting the current flowing from said third LED array to said negative output of said rectifier in accordance with said current detected by said third current detection unit.

5. The LED driving circuit according to claim 4, wherein a plurality of said intermediate circuits are connected between said first circuit and said second circuit.

6. The LED driving circuit according to claim 1, wherein said second LED array is connected in parallel with said first current limiting unit.

7. The LED driving circuit according to claim 1, wherein said current limiting unit is a current regulating circuit, a current regulative diode, or a current limiting resistor.

8. The LED driving circuit according to claim 1, further comprising a smoothing circuit connected to said rectifier.

9. An LED driving circuit comprising:

a rectifier having a positive output and a negative output;

a first circuit which includes a first LED array connected to said rectifier, a first current detection unit for detecting current flowing from said first LED array to said negative output of said rectifier, and a first current limiting unit for limiting the current flowing from said first LED array to said negative output of said rectifier in accordance with said current detected by said first current detection unit; and a second circuit which includes a second LED array and a current path passing through said second LED array and leading to said negative output of said rectifier, and wherein:

said first current limiting unit and said second LED array are connected in parallel, and said first current detection unit is located outside said parallel connection of said first current limiting unit and said second LED array, and a current path in which only said first LED array is connected to said rectifier and a current path in which said first LED array and said second LED array are connected in series relative to said rectifier are formed in accordance with an output voltage of said rectifier.

10. An LED driving circuit comprising:

a rectifier having a positive output and a negative output;

a first circuit which includes a first LED array connected to said rectifier, a first current detection unit for detecting current flowing from said first LED array to said negative output of said rectifier, and a first current limiting unit for limiting the current flowing from said first LED array to said negative output of said rectifier in accordance with said current detected by said first current detection unit;

a second circuit which includes a second LED array and a current path passing through said second LED array and leading to said negative output of said rectifier; and an intermediate circuit which is connected between said first circuit and said second circuit, and which includes a third LED array, a third current detection unit for detecting current flowing from said third LED array to said negative output of said rectifier, and a third current limiting unit for limiting the current flowing from said third LED array to said negative output of said rectifier in accordance with said current detected by said third current detection unit, wherein a current path in which only said first LED array is connected to said rectifier and a current path in which said first LED array and said second LED array are connected in series relative to said rectifier are formed in accordance with an output voltage of said rectifier, and said first current detection unit, upon detecting current flowing through said first and second LED arrays, operates said first current limiting unit so as to effect switching to said current path in which said first LED array and said second LED array are connected in series relative to said rectifier.

11. The LED driving circuit according to claim 10, wherein a plurality of said intermediate circuits are connected between said first circuit and said second circuit.

* * * * *